US010773174B1

(12) United States Patent
Mullin

(10) Patent No.: US 10,773,174 B1
(45) Date of Patent: Sep. 15, 2020

(54) AUTOMATED DEVICES USING ROTATIONAL MOTION TO APPLY CHALK TO A SURFACE

(71) Applicant: Make Ideas, LLC, La Jolla, CA (US)

(72) Inventor: Keith Alan Mullin, La Jolla, CA (US)

(73) Assignee: Make Ideas, LLC, La Jolla, CA (US)

( * ) Notice: Subject to any disclaimer, the term of this patent is extended or adjusted under 35 U.S.C. 154(b) by 0 days.

(21) Appl. No.: 16/015,152

(22) Filed: Jun. 21, 2018

Related U.S. Application Data

(60) Provisional application No. 62/522,844, filed on Jun. 21, 2017, provisional application No. 62/630,555, filed on Feb. 14, 2018.

(51) Int. Cl.

| | |
|---|---|
| ***A63H 17/26*** | (2006.01) |
| ***A63H 30/04*** | (2006.01) |
| ***A63C 19/08*** | (2006.01) |
| *A63H 17/25* | (2006.01) |

(52) U.S. Cl.
CPC ..... *A63H 17/262* (2013.01); *A63C 19/08* (2013.01); *A63H 30/04* (2013.01); *A63H 17/25* (2013.01)

(58) Field of Classification Search
CPC ..... A63H 13/15; A63H 30/04; A63H 17/262; A63C 19/08
USPC ..... 446/146
See application file for complete search history.

(56) References Cited

U.S. PATENT DOCUMENTS

| | | | | |
|---|---|---|---|---|
| 2,701,417 | A * | 2/1955 | Graham | B43L 13/024 33/18.1 |
| 3,619,943 | A * | 11/1971 | Goodbody | A63H 17/262 446/469 |
| 5,529,432 | A | 6/1996 | Huynh et al. | |
| 6,719,467 | B2 | 4/2004 | Hess et al. | |
| 7,029,199 | B2 | 4/2006 | Mayfield et al. | |
| 7,503,828 | B2 * | 3/2009 | Lee | A63H 17/16 446/440 |
| 8,758,076 | B1 | 6/2014 | Austin | |
| 2010/0095545 | A1 | 4/2010 | Miller | |
| 2011/0039021 | A1 | 2/2011 | Persson et al. | |
| 2016/0375700 | A1 | 12/2016 | Moncavage | |
| 2017/0269586 | A1 * | 9/2017 | D'Andrea | A63H 30/04 |

* cited by examiner

*Primary Examiner* — Laura Davison
(74) *Attorney, Agent, or Firm* — Tillman Wright, PLLC; James D. Wright; David R. Higgins

(57) ABSTRACT

Various devices utilize rotational movement of a piece of chalk to apply a graphic to a surface. Such a device includes a chassis, a motor connected to the chassis, a solid piece of chalk supported by a mounting structure carried by the chassis, and a rotatable axle or spindle that transmits rotational movement from the motor to the solid piece of chalk via the mounting structure such that the solid piece of chalk may be sanded by a surface to render a graphic to the surface. Some such devices are vehicles. Various systems include such devices as well as remote communication devices for operational control.

15 Claims, 20 Drawing Sheets

AUTOMATED DEVICES USING ROTATIONAL MOTION TO APPLY CHALK TO A SURFACE

CROSS-REFERENCE TO RELATED APPLICATION

The present application is a U.S. nonprovisional patent application of, and claims priority under 35 U.S.C. § 119(e) to, U.S. provisional patent application Ser. No. 62/522,844 filed Jun. 21, 2017, a copy of which is attached hereto as Appendix A, and U.S. provisional patent application Ser. No. 62/630,555 filed Feb. 14, 2018, a copy of which is attached hereto as Appendix B. Both provisional patent applications are incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE PRESENT INVENTION

Field of the Present Invention

The present invention relates generally to automated devices where rotational motion of chalk is used to apply the chalk to a surface either randomly or through a programmable and wireless interface.

Background

It can be appreciated that automated devices such as vehicles, motorized vehicles, remote control vehicles, toy vehicles, robot vehicles, and the tire and wheel assemblies providing locomotion, for such vehicles to move have been in use for years. Typically, wheels used for locomotion for such vehicles include alloy wheels, artillery wheels, casters, big wheels, cartwheels, mansell wheel, mecanum wheel, omni wheel, wire wheels and the like. Tires used for locomotion on such wheels include rubber tires, plastic tires, polymer tires, clay tires and metal tires. While these wheel and tire devices and systems may be suitable for the particular purpose to which they address, they are not suitable for creating images and designs on pavement. The present invention is an improvement to current tire and wheel assemblies, and more specifically, the invention is used to mark, render or draw images and designs on pavement by rotary sanding of solid chalk on such pavement surfaces, while providing locomotion for a vehicle.

Other pavement marking devices such as U.S. Pat. No. 7,029,199 ("Automatic Ground Marking Method and Apparatus") discloses a ground marking apparatus that uses a laser based electronic distance measuring device that includes a controllable marking system that includes a reservoir for a marking medium, such as paint, and a dispensing nozzle. The controllable marking system in the '199 patent is not a wheel system and does not provide locomotion for the '199 apparatus nor rotary sanding of solid chalk on surfaces.

U.S. Pat. No. 8,758,076 ("Radio-controlled toy for free form drawing") discloses a toy that draws freeform images on pavement via manual and stored drawing sequence controls via radio control of a drawing toy. The toy vehicle disclosed in the '076 patent has its drawing implement holder system attached to its body and does not provide locomotion for the vehicle, and does not rotate the drawing implement to keep the implement sharp. The drawing implement of the '076 vehicle, and of other such prior art, is a separate system from the wheels used to move the '076 vehicle and the drawing implement does not provide locomotion for vehicle movement nor rotary sanding of solid chalk on surfaces.

U.S. Patent Publication No. 2010/0095545 ("Chalk drawing device and method") discloses a stationary base device, without wheels or locomotion, that uses a tape measure for the user to mark pavement with chalk. U.S. Pat. No. 5,529,432 ("Apparatus and method for marking a surface"), U.S. Pat. No. 6,719,467 ("Floor printer"), U.S. Patent Publication No. 2011/0039021 ("Marking of large surface with visual presentations"), and U.S. Patent Publication No. 20160375700 ("Portable Image Printing Device") all likewise disclose devices using surface marking mechanisms that do not provide locomotion for the vehicle device nor rotary sanding of solid chalk on surfaces.

A problem with the devices described above is that they do not have tire and wheel assemblies that rotary sand solid chalk on surfaces to render images and designs, with the tire and wheel system also providing locomotion for the vehicle or device.

Another problem with such aforementioned vehicles that use a solid chalk stick for drawing, such vehicles only hold the chalk stick in a static and flat manner and scrape the chalk stick against surfaces, thus are not able to sharpen a solid chalk stick to render a line that is consistent in thickness and boldness.

Another problem with such aforementioned vehicles that use a solid chalk stick for drawing, is that the chalk is not used as a tire and mounted on a wheel, where the chalk tire and wheel system can be mounted on an axle.

Another problem with such aforementioned vehicles that use a solid chalk stick for drawing, is that the chalk is not used as a tire and mounted on a wheel, where the chalk tire and wheel system can be mounted on an axle, where the chalk tire and wheel system can be easily removed from the axle and changed with a new chalk tire and wheel system, when the chalk tire has been sanded and worn down.

Another problem with such aforementioned vehicles that use solid chalk for drawing, is that such vehicles do not have a solid chalk tire that is permanently mounted on a wheel, where the wheel is disposed, once the chalk tire has been sanded and worn down can replaced with a spare or new chalk tire and wheel.

Another problem with such aforementioned vehicles that use solid chalk for drawing, is that such vehicles do not have a solid chalk tire, that is manufactured by the method of casting a chalk tire directly onto a wheel during manufacture, for permanent mounting of a chalk tire on a wheel.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

SUMMARY OF THE PRESENT INVENTION

Broadly defined, the present invention according to at least a first aspect pertains to a device utilizing rotational movement of a piece of chalk to apply a graphic to a surface, including: a chassis; a motor connected to the chassis; a solid piece of chalk supported by a mounting structure carried by the chassis; and a rotatable axle or spindle that transmits rotational movement from the motor to the solid piece of chalk via the mounting structure such that the solid piece of chalk may be sanded by a surface to render a graphic to the surface. In a feature of this aspect, the device may be moved, relative to the surface, under the control of operational input received from a remote communication device.

In another feature of this aspect, the device is a self-propelled vehicle, and the chassis is a vehicle chassis.

In various sub-features, the solid piece of chalk is part of a chalk wheel assembly, the rotatable axle or spindle is a vehicle axle, and the vehicle axle transmits rotational movement from the motor to the chalk wheel assembly such that the chalk wheel assembly is sanded by a surface on which the vehicle is driven to render the graphic to the surface; the solid piece of chalk is a chalk tire, the mounting structure is a wheel that is part of the chalk wheel assembly, and the vehicle axle transmits rotational movement from the motor to the chalk wheel assembly such that the chalk tire is sanded by a surface on which the vehicle is driven; the chalk tire is semi-permanently mounted to the wheel such that the chalk tire may be replaced after being worn down by being sanded by the surface; the chalk tire is ring-shaped with a flat periphery; the chalk tire is torus-shaped; the chalk tire is semi-conically shaped; the vehicle includes a plurality of chalk wheel assemblies; and/or rotation of the chalk tires propels the vehicle.

In further sub-features, the solid piece of chalk is part of a rotary sanding chalk device and the axle or spindle rotates about an axis that is directed downward toward the surface such that a lower end of the solid piece of chalk is sanded by a surface on which the vehicle is driven to render the graphic to the surface; the device further includes a wheel assembly that propels the vehicle on the surface while the solid piece of chalk rotates and is sanded by the surface; the vehicle is partially supported by the solid piece of chalk; the solid piece of chalk is biased downward relative to the chassis; the device includes two wheel assemblies that propel the vehicle on the surface while the solid piece of chalk rotates and is sanded by the surface; the solid piece of chalk, mounting structure, and rotatable axle or spindle are a first solid piece of chalk, first mounting structure, and first rotatable axle or spindle, the device further comprises a second solid piece of chalk, a second mounting structure, and a second rotatable axle or spindle, and rotational movement is transmitted to the second solid piece of chalk via the second mounting structure such that the second solid piece of chalk may be sanded by the surface to render a graphic to the surface; the solid piece of chalk, the mounting structure, and the rotatable axle or spindle form a first rotary sanding chalk device, wherein the device further comprises at least two other rotary sanding chalk devices that each include a respective solid piece of chalk, mounting structure, and rotatable axle or spindle, and wherein the vehicle is fully supported on the at least three rotary sanding chalk devices.

In another feature of this aspect, the device further includes a wireless receiver to receive the operational input from the remote communication device. In further features, the wireless receiver receives the operational input from a remote communication device that is a mobile smart device; and/or the wireless receiver receives the operational input from a remote communication device that is a remote controller.

Broadly defined, the present invention according to at least a second aspect pertains to a system utilizing rotational movement of a piece of chalk to apply a graphic to a surface, including: a chalk drawing device that incorporates a chassis, a motor connected to the chassis, a wireless receiver to receive operational input, a solid piece of chalk supported by a mounting structure carried by the chassis, and a rotatable axle or spindle that transmits rotational movement from the motor to the solid piece of chalk via the mounting structure such that the solid piece of chalk may be sanded by a surface to render a graphic to the surface; and a remote communication device, including a transmitter, to provide the operational input to the device, via the wireless receiver, to control the chalk drawing device. In a feature of this aspect, the chalk drawing device may be moved, relative to the surface, under the control of operational input received from the remote communication device.

In another feature of this aspect, the chalk drawing device is a self-propelled vehicle, and the chassis is a vehicle chassis.

In various sub-features, the solid piece of chalk is part of a chalk wheel assembly, the rotatable axle or spindle is a vehicle axle, and the vehicle axle transmits rotational movement from the motor to the chalk wheel assembly such that the chalk wheel assembly is sanded by a surface on which the vehicle is driven to render the graphic to the surface; the solid piece of chalk is a chalk tire, the mounting structure is a wheel that is part of the chalk wheel assembly, and the vehicle axle transmits rotational movement from the motor to the chalk wheel assembly such that the chalk tire is sanded by a surface on which the vehicle is driven; the chalk tire is semi-permanently mounted to the wheel such that the chalk tire may be replaced after being worn down by being sanded by the surface; the chalk tire is ring-shaped with a flat periphery; the chalk tire is torus-shaped; the chalk tire is semi-conically shaped; the vehicle includes a plurality of chalk wheel assemblies; and/or rotation of the chalk tires propels the vehicle.

In further sub-features, the solid piece of chalk is part of a rotary sanding chalk device and the axle or spindle rotates about an axis that is directed downward toward the surface such that a lower end of the solid piece of chalk is sanded by a surface on which the vehicle is driven to render the graphic to the surface; the system further includes a wheel assembly that propels the vehicle on the surface while the solid piece of chalk rotates and is sanded by the surface; the vehicle is partially supported by the solid piece of chalk; the solid piece of chalk is biased downward relative to the chassis; the chalk drawing device includes two wheel assemblies that propel the vehicle on the surface while the solid piece of chalk rotates and is sanded by the surface; the solid piece of chalk, mounting structure, and rotatable axle or spindle are a first solid piece of chalk, first mounting structure, and first rotatable axle or spindle, wherein the device further comprises a second solid piece of chalk, a second mounting structure, and a second rotatable axle or spindle, and wherein rotational movement is transmitted to the second solid piece of chalk via the second mounting structure such that the second solid piece of chalk may be sanded by the surface to render a graphic to the surface; and/or the solid piece of chalk, the mounting structure, and the rotatable axle or spindle form a first rotary sanding chalk device, wherein the chalk drawing device further comprises at least two other rotary sanding chalk devices that each include a respective solid piece of chalk, mounting structure, and rotatable axle or spindle, and wherein the vehicle is fully supported on the at least three rotary sanding chalk devices.

In another feature of this aspect, the system further includes a wireless receiver to receive the operational input from the remote communication device. In further features, the remote communication device is a mobile smart device that transmits the operational input to the chalk drawing device; the graphic corresponds to an image on the mobile smart device, and the operational input corresponds to instructions for controlling the chalk drawing device to produce the graphic according to the image; and/or the remote communication device is a remote controller that transmits the operational input to the chalk drawing device.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION

Figure 1:
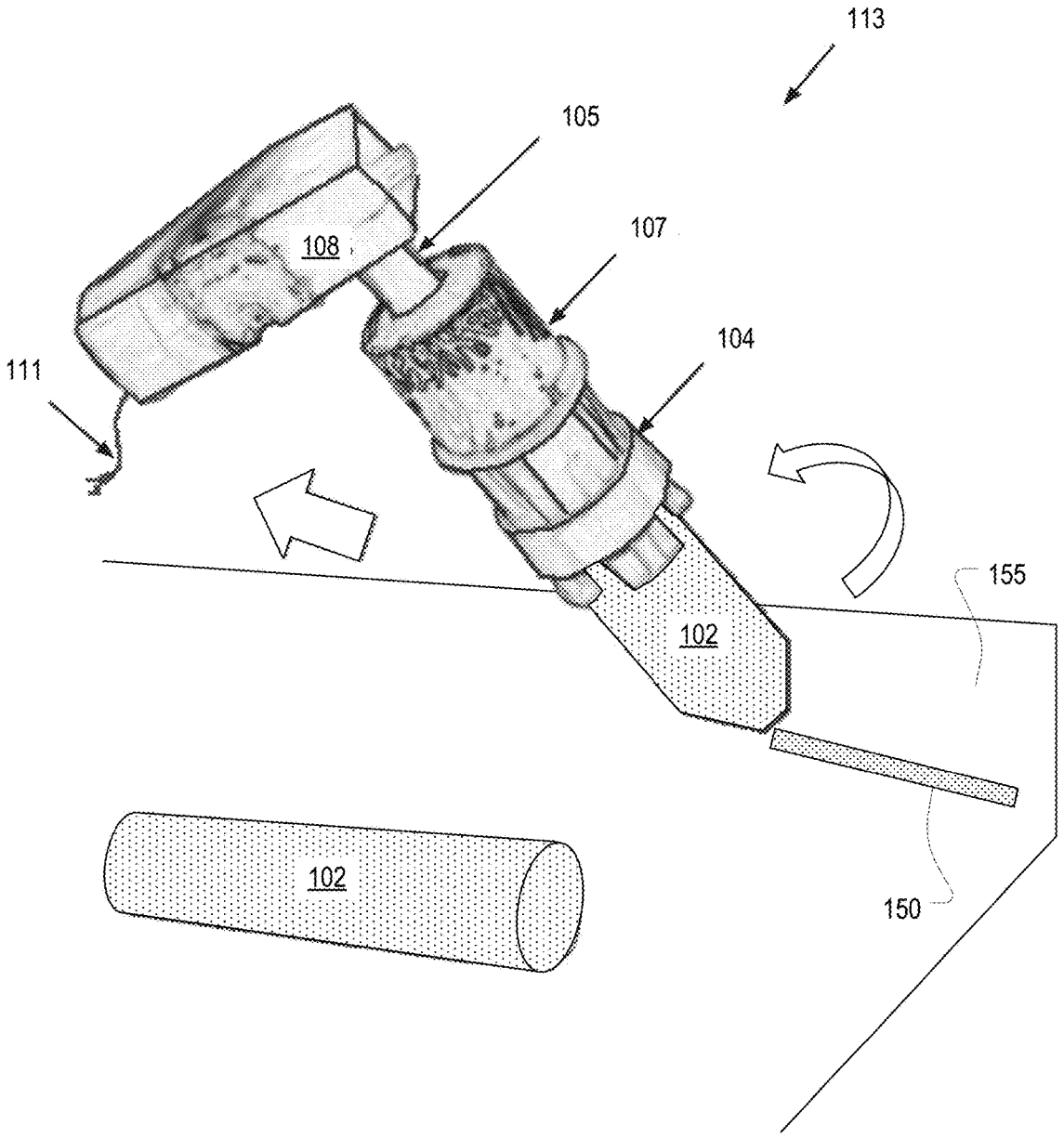
FIG. 1 is a perspective view of a rotary sanding chalk device in accordance with one or more preferred embodiments of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, one or more preferred embodiments of the present invention are next described. The following description of one or more preferred embodiment(s) is merely exemplary in nature and is in no way intended to limit the invention, its application, or uses.

FIG. 1 is a perspective view of a rotary sanding chalk device 113 in accordance with one or more preferred embodiments of the present invention. With suitable modifications for each respective implementation, such a chalk device 113 may be mounted in various motorized drawing vehicles, mechanical devices, and the like, including the vehicles 100,200,300,400,500 and handheld devices 600, 700 described and illustrated herein. The chalk device 113 shown in FIG. 1 includes a chassis 107 supporting a mounting structure 104 for holding chalk 102. The rotary sanding chalk device 113 also includes an axle or spindle 105 and a motor 108 attached to the axle 105. The motor 108 can be an electric motor, internal combustion engine or other motor or engine known by an Ordinary Artisan, or in the industry or art, that may be used for the purposes and system as described herein. The motor 108 includes one or more wires 111. The wires 111 can be attached to a battery 112 and/or control electronics 110.

The chalk 102 is made of solid material with the material composition being mineral chalk, other mineral sources of calcium carbonate, the mineral gypsum (calcium sulfate), Plaster of Paris or plaster. Chalk 102 can also be made of calcium carbonate and may be made minor amounts of silt and clay. Pigments, such as liquid tempera paints, can be added to the chalk during manufacture to produce chalk 102 in different colors. Various particulates can also be added into the chalk 102 during manufacture such as flint (to produce sparks) or other such substances to produce sound or visual effect when the chalk 102 is rotary sanded. The chalk 102 can be made with any material as known by an Ordinary Artisan, or in the industry or art, that may be used for the purposes and system as described herein. Also shown in FIG. 1 is a spare piece of chalk 102 which may be used to replace the chalk installed in the chalk device 113 when it has been worn down.

As the device 113 is moved around a pavement surface 155 or other surface, and the motor 108 controlling the axle 105 and mounting structure 104 spins the chalk 102, the chalk 102 is worn down by the rotary sanding action of the pavement surface 155 against the chalk 102. As the chalk 102 is worn down it renders graphics 150 on the pavement surface 155.

Figure 2:
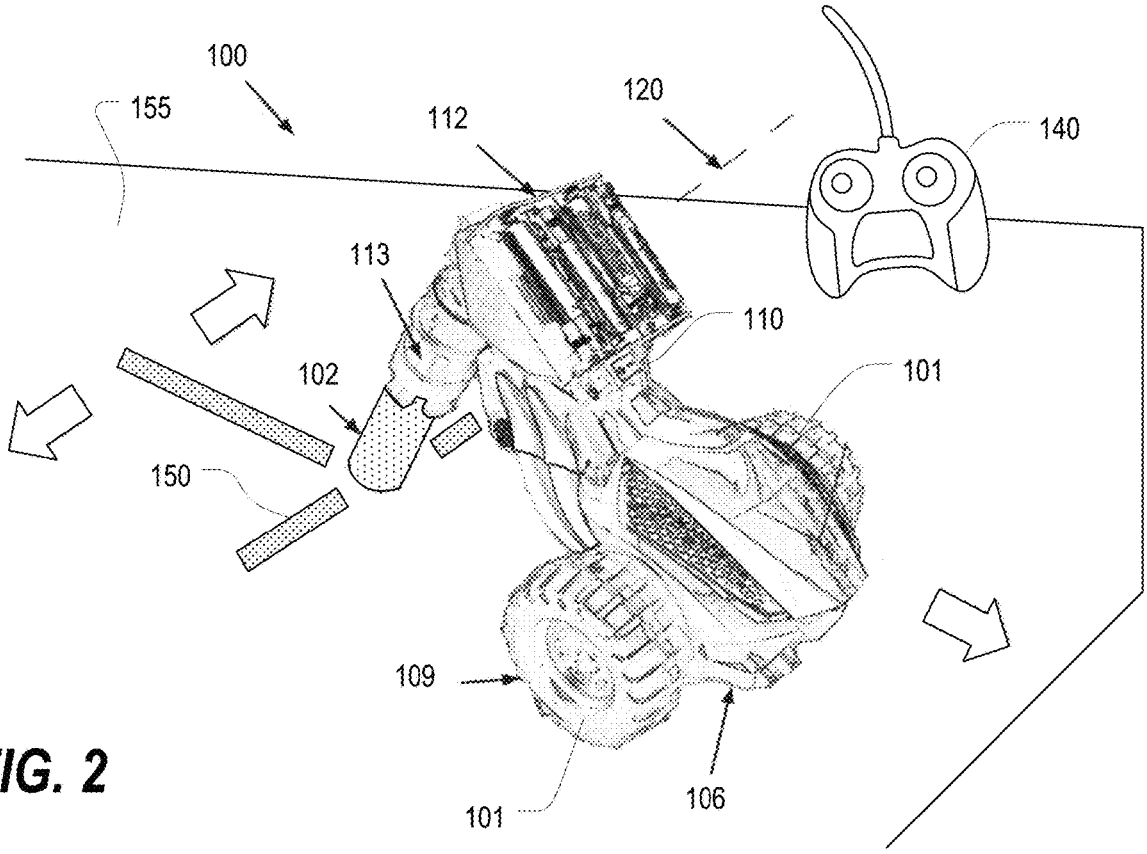
FIG. 2 is perspective rear view of a motorized drawing vehicle with one rotary sanding chalk device mounted to the vehicle in accordance with one or more further preferred embodiments of the present invention.

FIG. 2 is perspective rear view of a motorized drawing vehicle 100 with one rotary sanding chalk device 113 mounted to the vehicle 100 in accordance with one or more further preferred embodiments of the present invention. The drawing vehicle 100 is a self-powered vehicle that houses and contains all the elements and components to move and draw graphics 150. The drawing vehicle 100 includes a chassis 106. Mounted to the chassis 106 are a rotary sanding chalk device 113, a battery 112, a body 116, and a standard wheel assembly 109 with two standard tires 101 mounted on wheels. Standard tires 101 can be rubber tires, plastic tires, polymer tires, or any such tires which are known by an Ordinary Artisan, or in the industry or art, that may be used for the purposes and system as described herein. Alternatively, wheel assemblies may include solid wheels, of various materials, that do not include separate tires.

The motor 108 of the chalk device 113 is connected to the battery 112 and control electronics 110 by wires 111. FIG. 2 also shows a remote controller 140 which can be used to communicate to the control electronics 110 via a communications method 120 which might include but is not limited to a transmitter and receiver and can be of any wireless communication method.

The drawing vehicle 100 has multiple motors 108 which are all connected to the chassis 106. Each motor 108 drives either the tires 101 in the wheel assembly 109 or the chalk device 113 separately and independently for various acceleration, speed and direction.

As the drawing vehicle 100 moves around the pavement surface 155 or other surface, and the motor 108 controlling the sanding chalk device 113 spins the chalk 102, the chalk 102 is worn down by the rotary sanding action of the pavement surface 155 against the chalk 102. As the chalk 102 is worn down it renders graphics 150 on the pavement surface 155. Because the tires 101 and chalk device 113 are all controlled by separate motors 108, the drawing vehicle 100 can move in multiple directions drawing graphics 150 in multiple directions.

Figure 3:
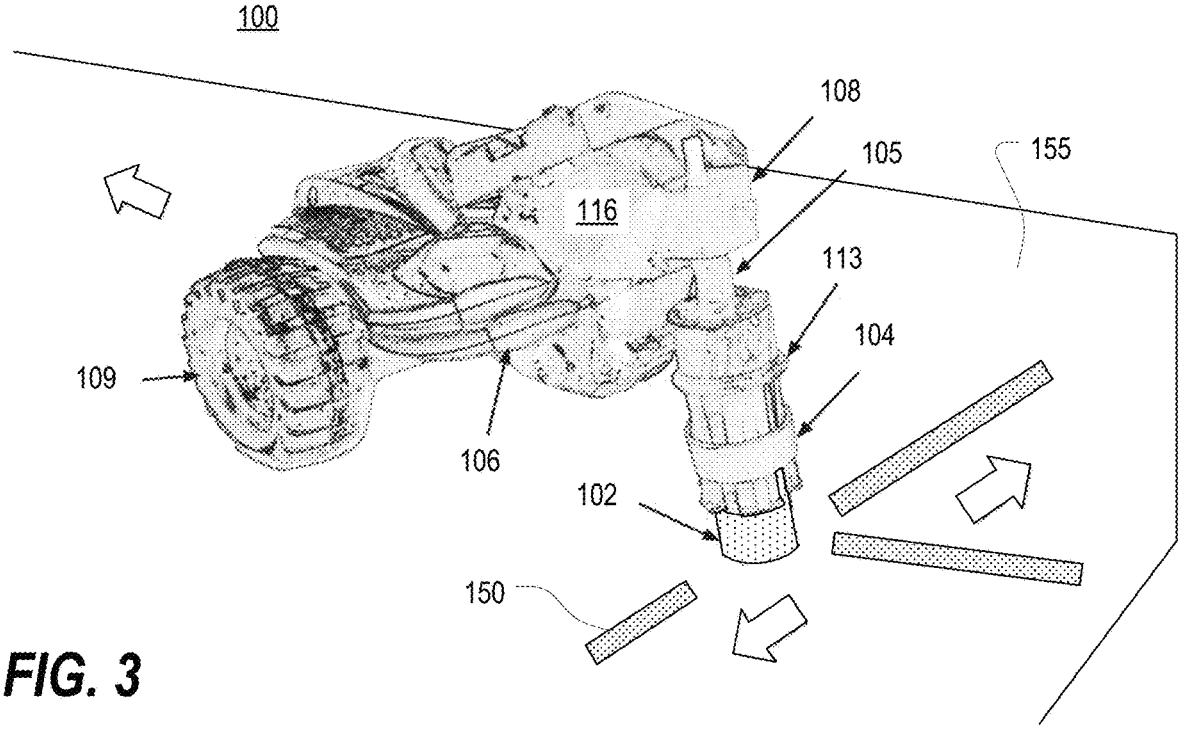
FIG. 3 is a perspective front view of the drawing vehicle shown in FIG. 2.

FIG. 3 is a perspective front view of the drawing vehicle 100 shown in FIG. 2.

FIG. 3 illustrates the chalk 102 of the sanding chalk device 113 being worn down almost to the mounting structure 104. Once the chalk 102 is worn down, the user can change out the worn-out chalk 102 with a new piece of chalk 102 to allow the drawing vehicle 100 to continue drawing graphics 150.

Figure 4:
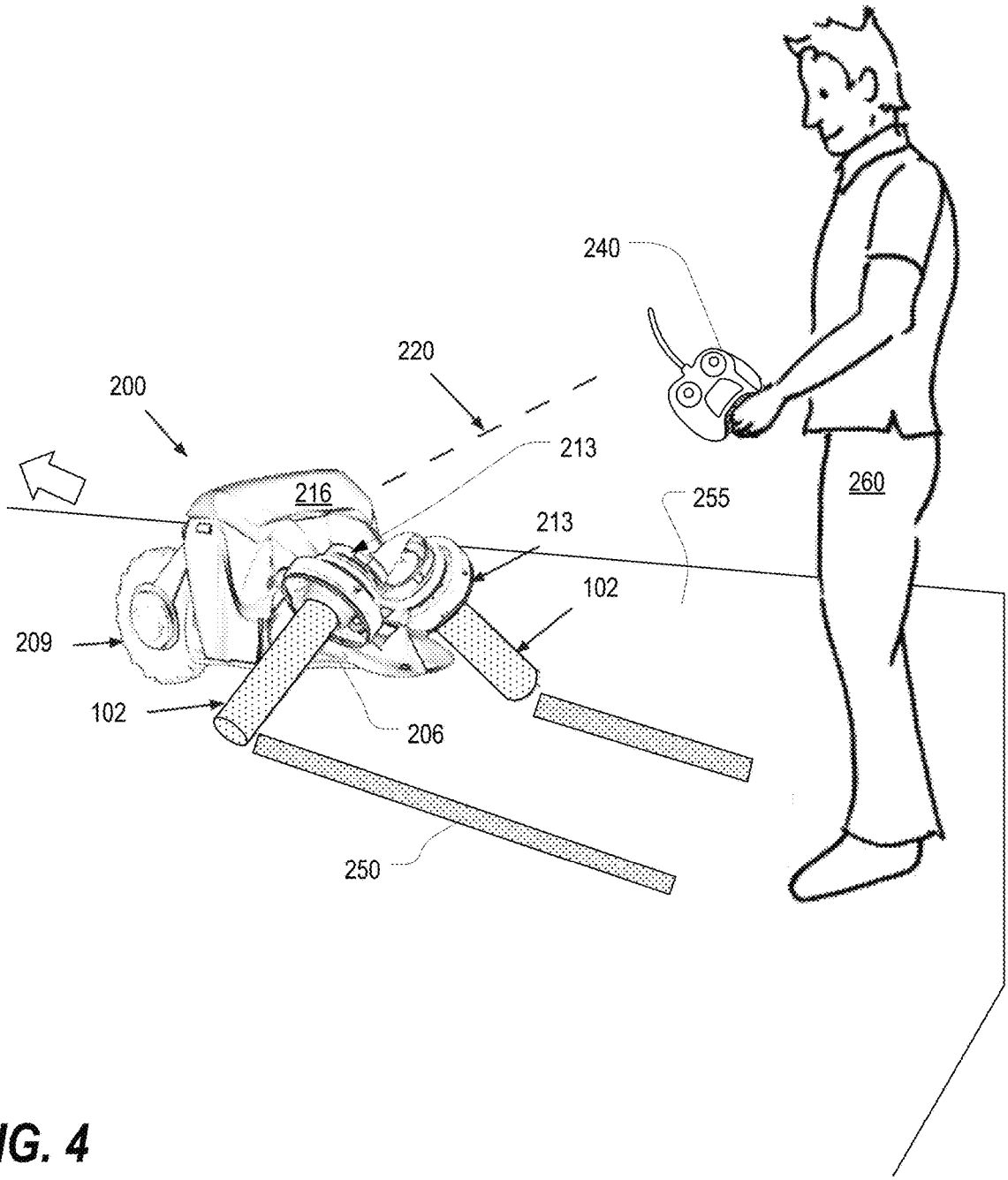
FIG. 4 is a perspective rear view of a user operating a motorized drawing vehicle with two rotary sanding chalk devices mounted to the vehicle in accordance with one or more further preferred embodiments of the present invention.

FIG. 4 is a perspective rear view of a user 260 operating a motorized drawing vehicle 200 with two rotary sanding chalk devices 213 mounted to the vehicle 200 in accordance with one or more further preferred embodiments of the present invention. As with the vehicle 100 of FIG. 2, the drawing vehicle 200 is a self-powered vehicle that houses and contains all the elements and components to move and draw graphics 250. The drawing vehicle 200 includes a chassis 206. Mounted to the chassis 206 are two rotary sanding chalk devices 213, a battery (not shown), a body 216, and one standard wheel assembly 209 with a conventional tire mounted on a wheel. In various embodiments, a drawing vehicle like the vehicles 100,200 of FIGS. 2 and 4 can have one or more standard wheel assemblies and one or more rotary sanding chalk devices 113,213 in various configurations. The motors 108 of the chalk devices 213 are connected to the battery 112 and control electronics 110 by wires 111 (not shown in FIG. 4). FIG. 4 also shows a remote controller 240 which can be used to communicate to the control electronics 110 via a communication method 220 which might include but is not limited to a transmitter and receiver and can be of any wireless communication method.

The drawing vehicle 200 has multiple motors 108 which are all carried on or otherwise connected to the chassis 206. Each motor 108 drives either the wheel assembly 209 or the chalk devices 213 separately and independently for various acceleration, speed and direction. As the drawing vehicle 200 moves around the pavement surface 255, and the respective motor 108 controlling each sanding chalk device spins its chalk 102, the chalk 102 is worn down by the rotary sanding action of the pavement surface 255 against the chalk 102. As the chalk 102 is worn down it renders graphics 250 on the pavement surface 255. Because the tire and chalk devices 213 are controlled by separate motors 108, the drawing vehicle 200 can move in multiple directions drawing graphics 250 in multiple directions.

In various embodiments, a drawing vehicle 100,200 may have two or more chalk devices 113,213 and one or more wheel assemblies 109,209 in various combinations. Each of the chalk devices 113,213 and wheel assemblies 109,209 may be controlled by individual motors 108 or one or more of the chalk devices 113,213 and wheel assemblies 109,209 may be controlled by the same motor 108. In at least some embodiments, the motors 108 are capable of rotating the pieces of chalk 102 in either direction, thereby providing greater control over the movement of the vehicle 200 through the rotational friction between the chalk 102 and the pavement surface 255.

Various drawing vehicles, including the vehicles 100,200, 400,500 of FIGS. 2-4 and 6-15 may use structural and mechanical components for operation, control and movement of such drawing vehicle. The structural and mechanical components can include such vehicle systems as steering, braking, structural, support, suspension, balance, protection, storage, lighting, sound, controls, and any other such system used by vehicles that are known by an Ordinary Artisan, or in the industry or art, that may be used for the purposes and system as described herein.

Figure 5:
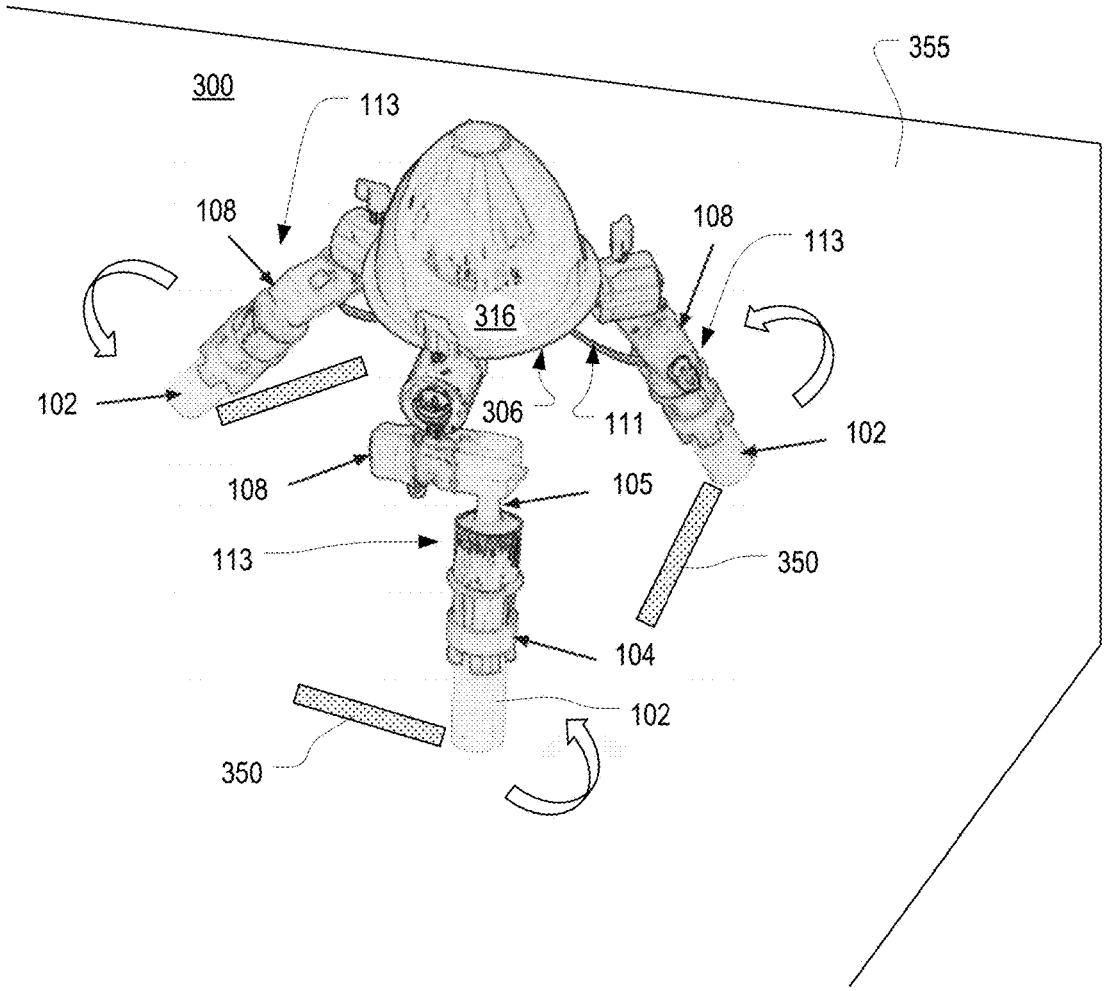
FIG. 5 is a perspective view of a motorized drawing vehicle utilizing three of the rotary sanding chalk devices of FIG. 1 in accordance with one or more further preferred embodiments of the present invention.

FIG. 5 is a perspective view of a motorized drawing vehicle 300 utilizing three of the rotary sanding chalk devices 113 of FIG. 1 in accordance with one or more further preferred embodiments of the present invention. Similar to the vehicle 100 of FIGS. 2 and 3, the drawing vehicle 300 of FIG. 5 is a self-powered vehicle that houses and contains all the elements and components to move and draw graphics 350. The drawing vehicle 300 includes a chassis 306. Mounted to the chassis 306 are three rotary sanding chalk devices 113, a battery (not shown), and a body 316. In other embodiments, rotary sanding chalk devices 113 of the drawing vehicle 300 may be arranged in various configurations. Also in other embodiments, the drawing vehicle 300 may have more than three rotary sanding chalk devices 113. The motors 108 of the chalk devices 113 are connected to a battery (not shown) and control electronics (not shown) by wires 111.

The drawing vehicle 300 preferably has multiple motors 108 which are all supported by the chassis 306. Each motor 308 preferably drives the chalk devices 113 separately and independently for various acceleration, speed and direction. As the drawing vehicle 300 moves around a pavement surface 355, and the motors 108 controlling the sanding chalk devices 113 spin the pieces of chalk 102, the pieces of chalk 102 are worn down by the rotary sanding action of the pavement surface 355 against the chalk 102. As the chalk 102 is worn down, it renders graphics 350 on the pavement surface 355. Because the chalk devices 113 are all controlled by separate motors 108, the drawing vehicle 300 can move in multiple directions drawing graphics 350 in multiple directions. In at least some embodiments, the motors 108 are capable of rotating the pieces of chalk 102 in either direction, thereby providing greater control over the movement of the vehicle 300 through the rotational friction between the chalk 102 and the pavement surface 355.

Figure 6:
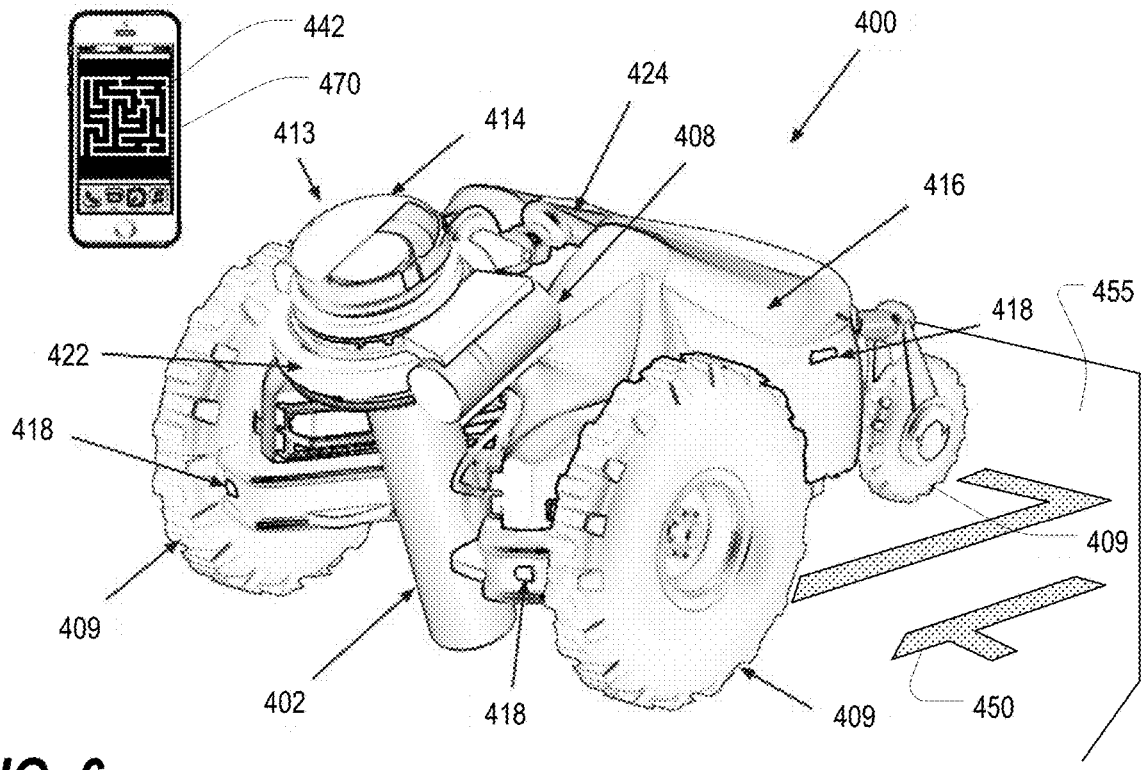
FIG. 6 is a perspective view of a motorized drawing vehicle with one rotary sanding chalk device mounted to the vehicle in accordance with one or more further preferred embodiments of the present invention.
Figure 9:
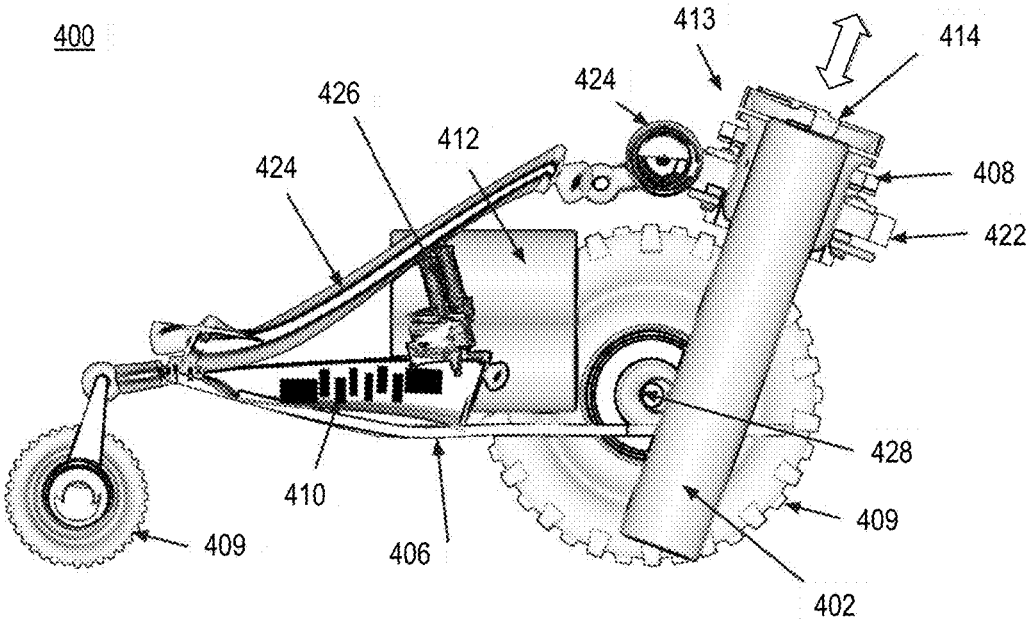
FIG. 9 is a side cross-sectional view of the motorized drawing vehicle of FIG. 8.
Figure 8:
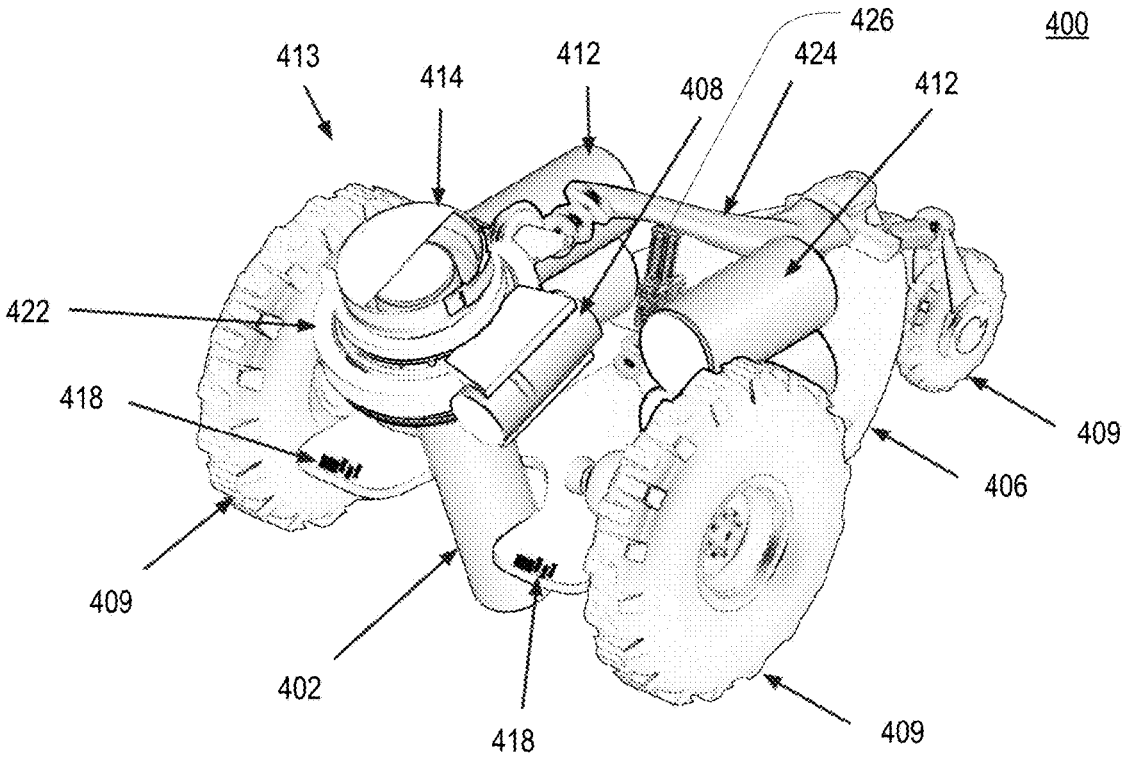
FIG. 8 is a perspective view of the motorized drawing vehicle of FIG. 6 but without the vehicle body.
Figure 7:
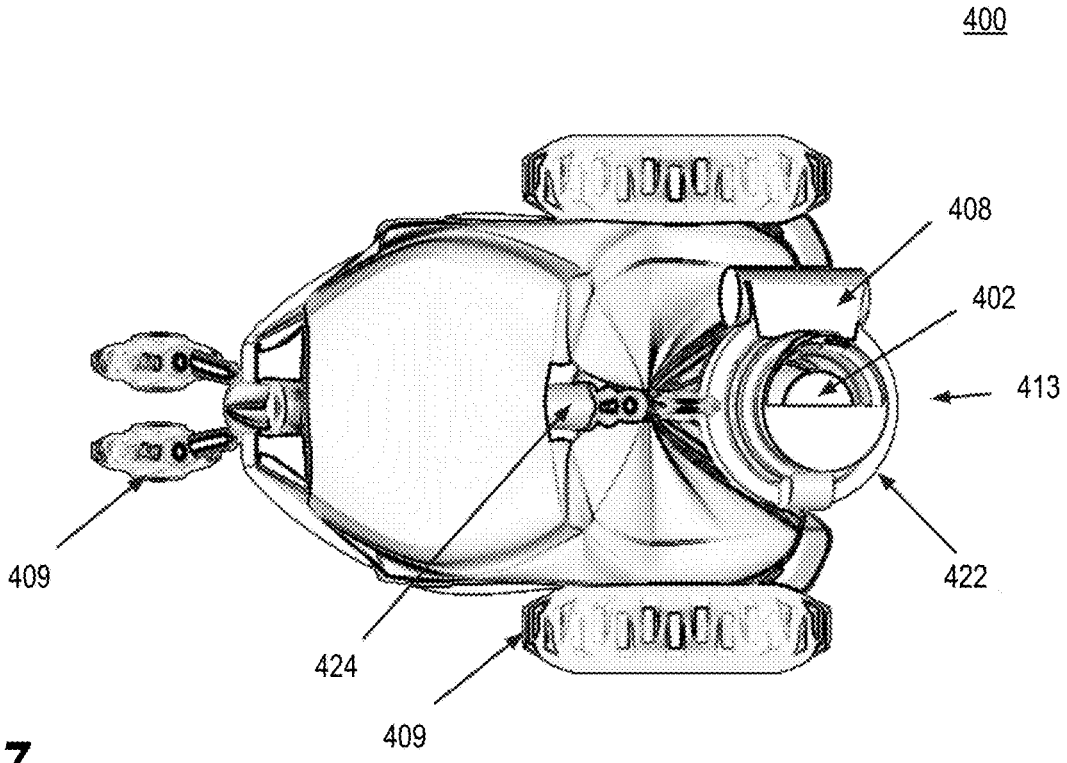
FIG. 7 is a top view of the motorized drawing vehicle of FIG. 6.

FIG. 6 is a perspective view of a motorized drawing vehicle 400 with one rotary sanding chalk device 413 mounted to the vehicle 400 in accordance with one or more further preferred embodiments of the present invention, while FIG. 7 is a top view of the motorized drawing vehicle 400 of FIG. 6, FIG. 8 is a perspective view of the motorized drawing vehicle 400 of FIG. 6 but without the vehicle body 416, and FIG. 9 is a side cross-sectional view of the motorized drawing vehicle 400 of FIG. 8. Similar to the previous embodiments, the drawing vehicle 400 is a self-powered vehicle that houses and contains all the elements and components to move and draw graphics 450. The drawing vehicle 400 includes a chassis 406. Mounted to the chassis 406 is a rotary sanding chalk device 413, one or more batteries 412, a body 416, one or more sensors 418, and three standard wheel assembles 409, which may or may not include separate tires. The chalk spinning motor 408 of the chalk device 413 is connected to the batteries 412 and control electronics 410 by wires (not shown). FIG. 6 also shows a mobile smart device 470 with a downloaded image 442.

In this embodiment, the rotary spinning chalk device 413 includes a chalk spinning motor 408 which is connected to the batteries 412 and control electronics 410 by wires. The chalk device 413 also includes a chalk feeder 414 and a chalk holder 422. The chalk device 413 has a support 424 and a support spring 426. The support spring 426 provides downward forces which keeps the chalk 402 in contact with the pavement surface 455 while the vehicle 400 is rendering graphics on the surface 455.

The drawing vehicle 400 has one or more motors 428 used to control the wheel assemblies 409. The motors 428 are all connected to the chassis 406. The chalk spinning motor 408 spins the chalk device 413 independently of the motors 428 that drive the wheel assemblies 409. These motors 408,428 can run separately and independently for various acceleration, speed and direction.

As perhaps best shown in FIG. 9, the chassis 406 is the support platform for the vehicle and is the structure to which most elements are attached. In the arrangement shown in FIGS. 6-9, the chalk device 413 holds and positions the chalk 402 along the centerline of the drawing vehicle 400. The control electronics 410 provide control and command for the drawing vehicle 400 and communication with the smart device 470 (or in some embodiments, with a remote controller 240) which combine to move and/or navigate the drawing vehicle 400 on the pavement or hard surface 455. As the vehicle 400 moves on the pavement 455, the chalk device 413 spins the chalk 402 and pushes the spinning chalk 402 onto the pavement 455, thereby rendering the graphic 450.

FIG. 8 perhaps best illustrates the interior components of the vehicle 400 in one or more further preferred embodiments of the invention, including a detailed view of the chalk device 413. By using the components, sensors and electronics of the smart device 470, such as a GPS subsystem, a smart device operating system, and a printing vehicle application 480, the drawing vehicle 400 is able to move and navigate on the pavement surface 455, so as to "print" a downloaded image 442 with the chalk 402. The batteries 412 provide power to the control electronics 410, sensors 418, the chalk spinning motor 408 and the other motors 428 of the drawing vehicle 400.

Figure 10:
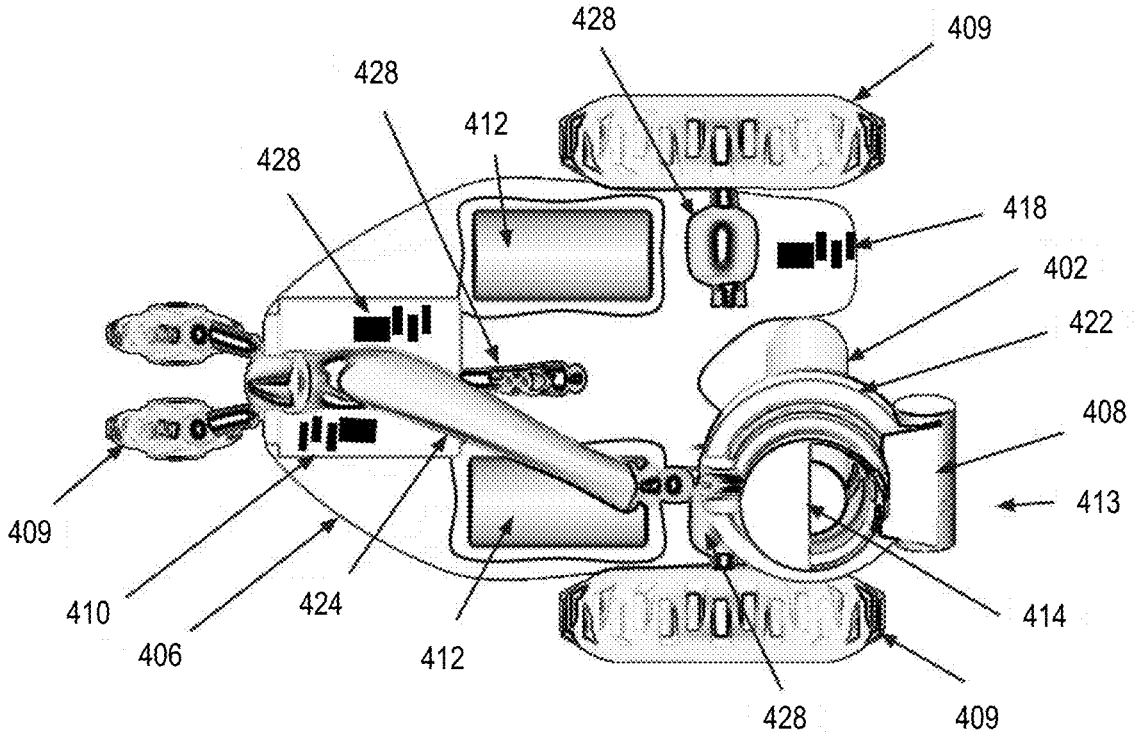
FIG. 10 is a top view of the motorized drawing vehicle shown in FIG. 8 but with an angled chalk device.
Figure 11:
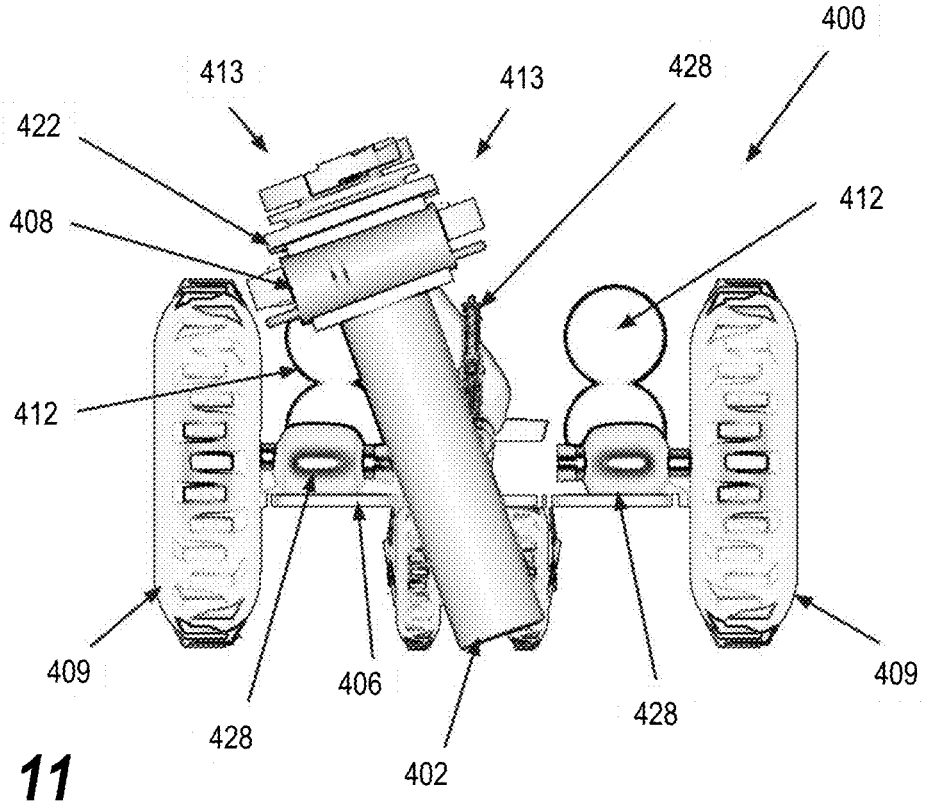
FIG. 11 is a front view of the motorized drawing vehicle of FIG. 10.

In some embodiments, the position and/or orientation of the chalk device 413 may be adjusted, relative to the rest of the vehicle 400, to enhance the rendering of the chalk line to a print quality or otherwise improve performance. In this regard, FIG. 10 is a top view of the motorized drawing vehicle 400 shown in FIG. 8 but with an angled chalk device 413, and FIG. 11 is a front view of the motorized drawing vehicle 400 of FIG. 10. In some embodiments, the angle of the chalk 402 may be adjusted by a user 260.

The mobile smart device 470 used with the vehicle 400 of FIG. 6 and with at least some other embodiments of a vehicle can be a mobile phone, tablet, computer, smart watch (such as an iPhone or Android phone) or other such smart device as known by an Ordinary Artisan, or in the industry or art, that may be used for the purposes and system as described herein to access an image 442 for rendering as a graphic 450 via a motorized drawing vehicle 400. The smart device 470 can have (but not limited to) sensors and controllers, such as GPS locator, accelerometer, compass, gyroscope, magnetometer, proximity sensor, light sensor, barometer, thermometer and pedometer, which can be used by the drawing vehicle 400 and smart device 470 to control the image drawn on the pavement or other solid surface 455. The smart device 470 can have internet access capabilities and sensors that can be used to access and download images to a printing vehicle application 480 and control the drawing vehicle 400. Once an image is downloaded by a user 260 onto the smart device 470, the user 260 can render or "print" the downloaded image 442 on a pavement surface 455 by utilizing the printing vehicle application 480 on the smart device 470 and communication method 220 which uses the sensors 418 and other elements for transferring data and/or monitoring location.

The communication method 220 is the manner in which the smart device 470 communicates with the internet cloud and the drawing vehicle 400. The remote controller 240 or smart device 470 may have a communication method 220, 520 that uses a transmitter and receiver and can be of any wireless communication method 220,520 or as known by an Ordinary Artisan, or in the industry or art, that may be used for the purposes and system as described herein. The word "cloud" often refers to the internet, and more precisely to data centers full of servers that are connected to the internet. Internet cloud computing is a type of computing that relies on sharing computing resources rather than having local servers or personal devices to handle applications. In internet cloud computing, the word cloud (sometimes referred to as "the cloud") is used as a metaphor for "the internet," and the phrase "cloud computing" may be understood as a type of internet-based computing, where different services (such as servers, data storage, image storage, and applications) are provided to, and delivered to mobile smart devices 470 and computers 570 through the internet.

As the drawing vehicle 400 moves around the pavement surface 455 and the chalk spinning motor 408 spins the chalk 402, the chalk 402 is worn down by the rotary sanding action of the pavement surface 455 against the chalk 402. As the chalk 402 is worn down, it renders graphics 450 on the pavement surface 455. Because the wheel assemblies 409 and chalk device 413 are all controlled by separate motors 408,428, the drawing vehicle 400 can move in multiple directions drawing graphics 450 in multiple directions to create graphics 450 stored in the printing vehicle application 480.

Figure 12:
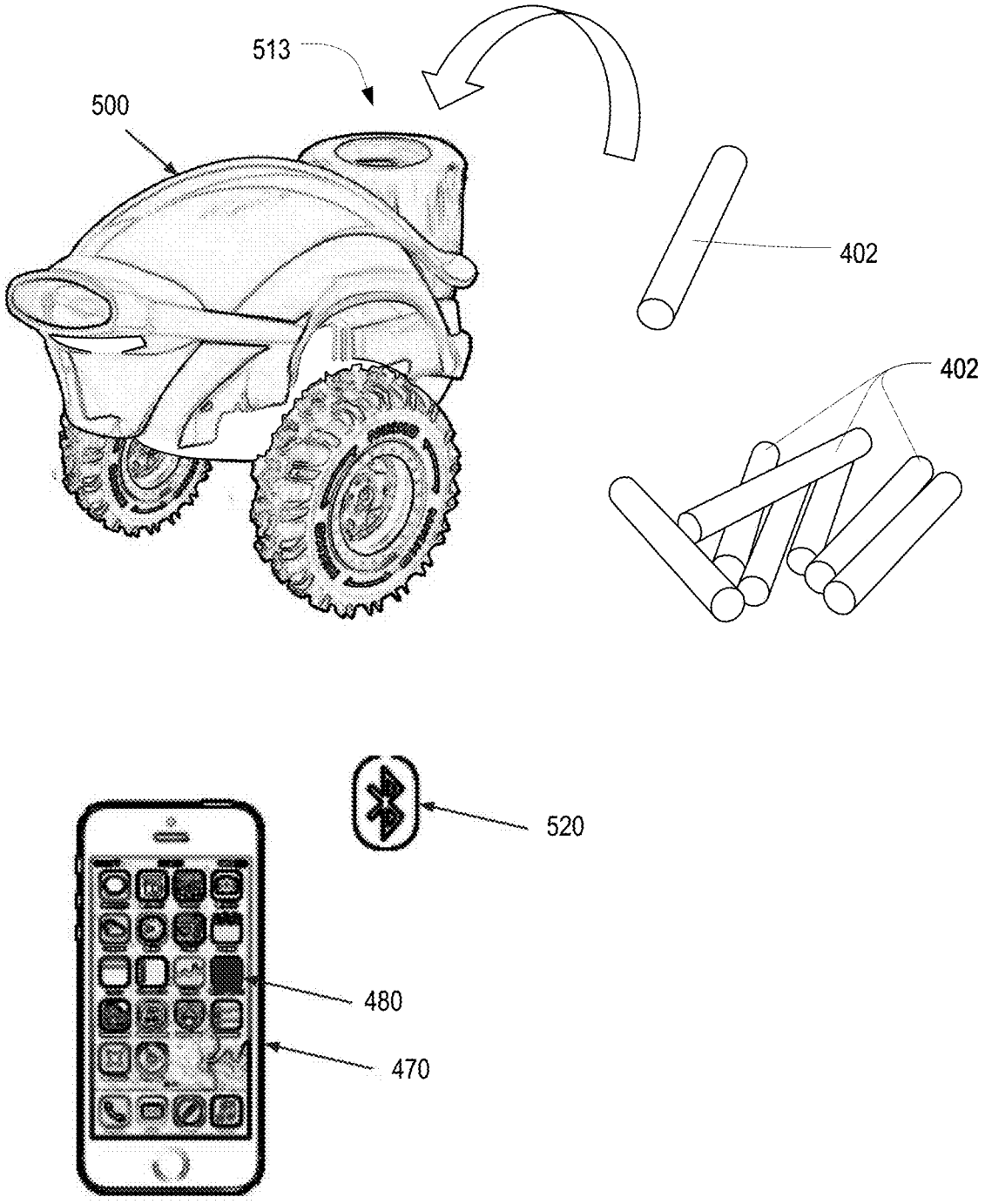
FIG. 12 is a perspective view of a motorized drawing vehicle together with a plurality of pieces of chalk and a mobile smart device, all in accordance with one or more further preferred embodiments of the present invention.

FIG. 12 is a perspective view of a motorized drawing vehicle 500 together with a plurality of pieces of chalk 402 and a mobile smart device 470, all in accordance with one or more further preferred embodiments of the present invention. The motorized drawing vehicle 500 includes a chalk device 513 into which the chalk 402 may be loaded. The mobile smart device 470 has a print application 480 for a user 260 to initiate a communication through a Bluetooth® connection 520 or the like.

Figure 13:
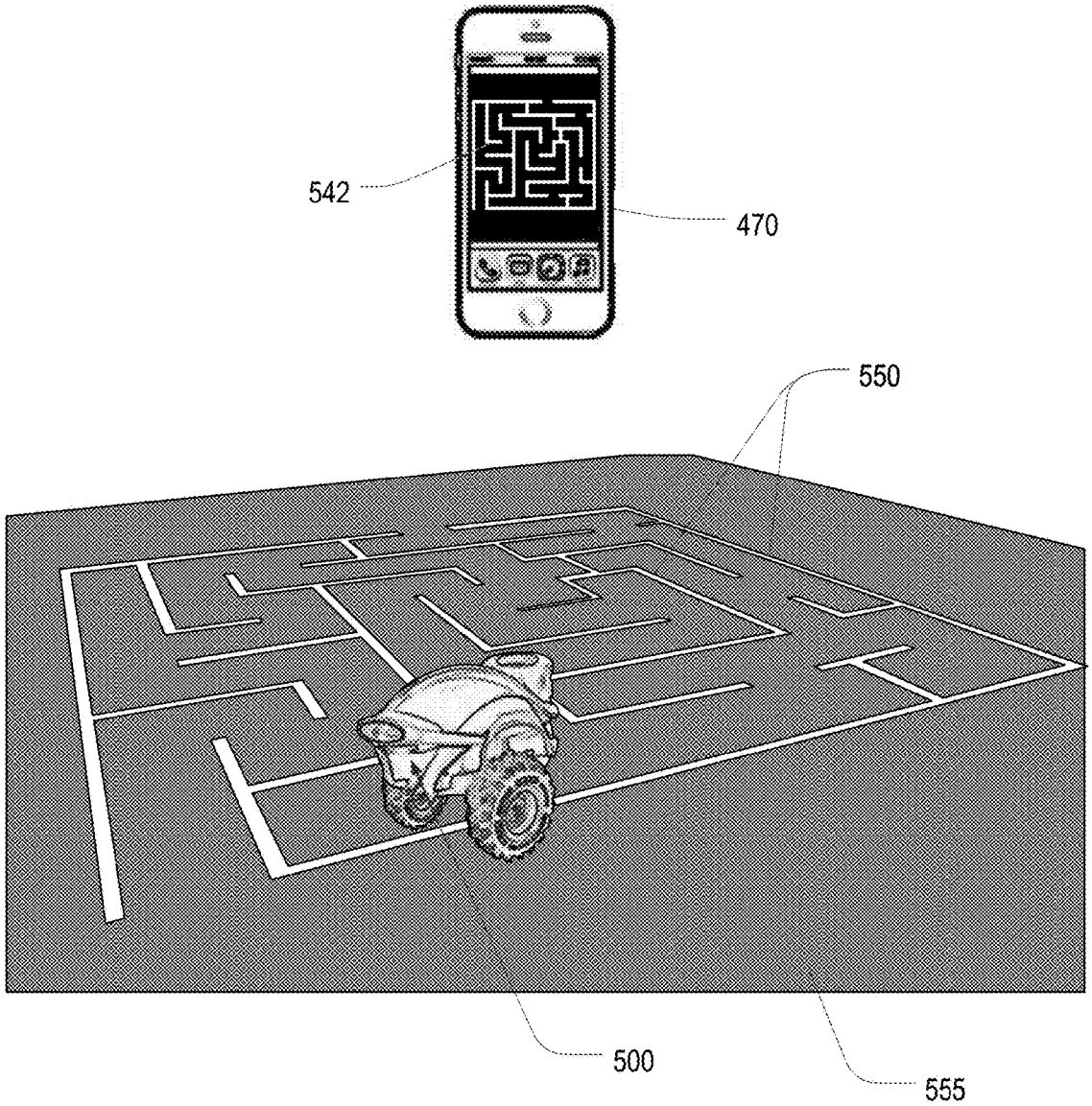
FIG. 13 is a perspective view of the motorized drawing vehicle of FIG. 12, shown in operation.

FIG. 13 is a perspective view of the motorized drawing vehicle 500 of FIG. 12, shown in operation. As shown in FIG. 13, the printing vehicle application 480 has been launched, causing a downloaded image 542 to be displayed on the device 470. In the exemplary illustration, the image 542 is a maze image, but it will be apparent that a wide variety of images may be used and created. FIG. 13 also shows the motorized drawing vehicle 500 using the chalk 402 to "print" the downloaded image 542 as a graphic 550 on a pavement surface 555.

Figure 14:
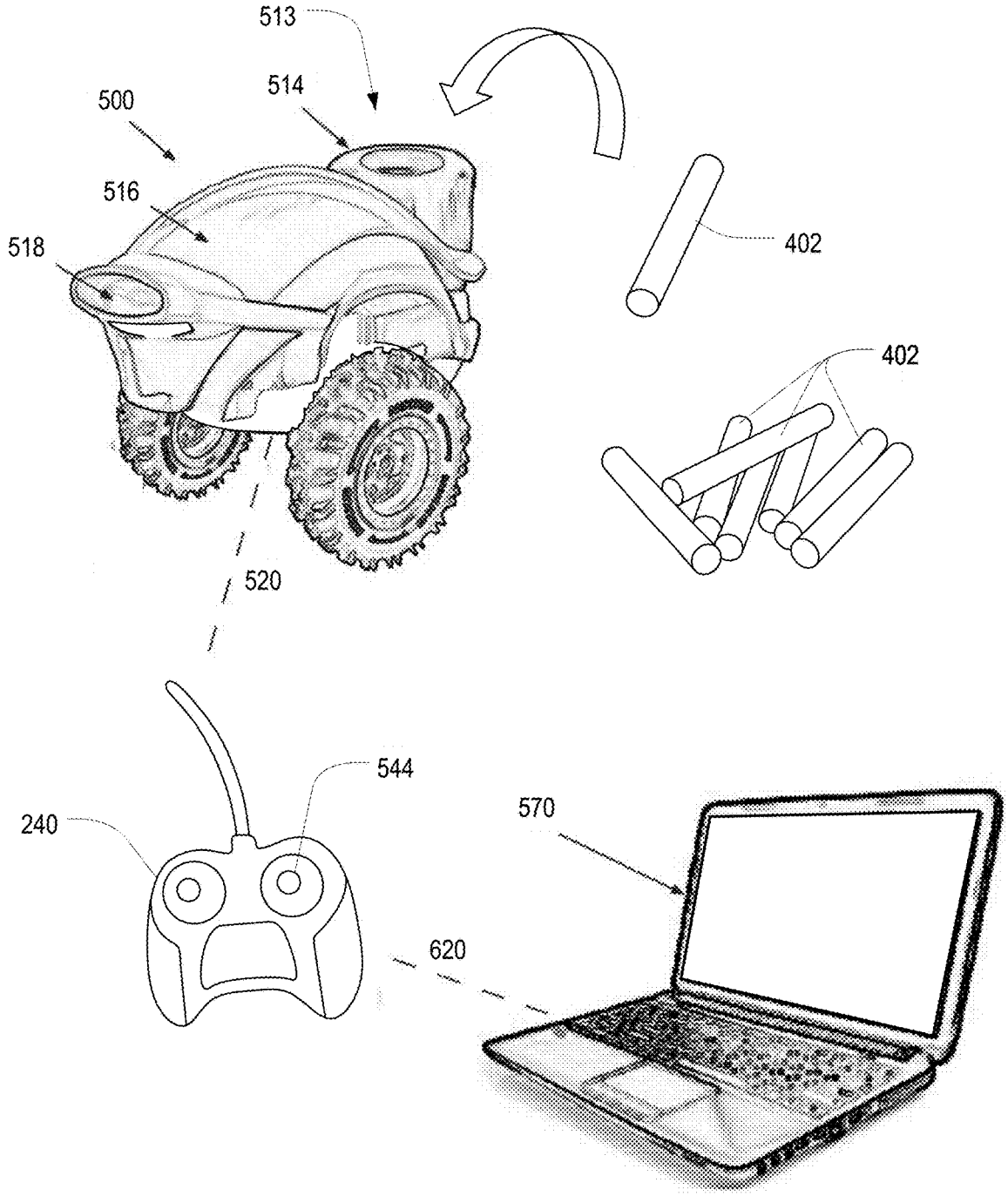
FIG. 14 is a perspective view of the motorized drawing vehicle of FIG. 12 together with a remote controller and a computer, all in accordance with one or more further preferred embodiments of the present invention.

FIG. 14 is a perspective view of the motorized drawing vehicle 500 of FIG. 12 together with a remote controller 240 and a computer 570, all in accordance with one or more further preferred embodiments of the present invention. The vehicle may include some or all of the elements and features utilized by others of the vehicles described and illustrated herein, such as a chalk feeder 514, vehicle body 516, sensors 518, and the like. As shown in FIG. 14, the controller 240 may utilize a print application executable button 544 for launching the vehicle printing application 480 for use by a user 260,560. In this embodiment, the controller 240 accesses images in or via the internet cloud through wireless communication 620 with a computer 570, which accesses the internet's cloud-based images. Alternatively, the controller 240 may be operable to access cloud-based images directly, may access images stored on the computer, or the like. The controller 240 is communicating with the motorized drawing vehicle 500 via a communication method 520, which is shown as radio control communication. Additionally or alternatively, the controller 240 may be plugged into a computer 570 using a standard wired connection such as a USB cable.

Figure 15:
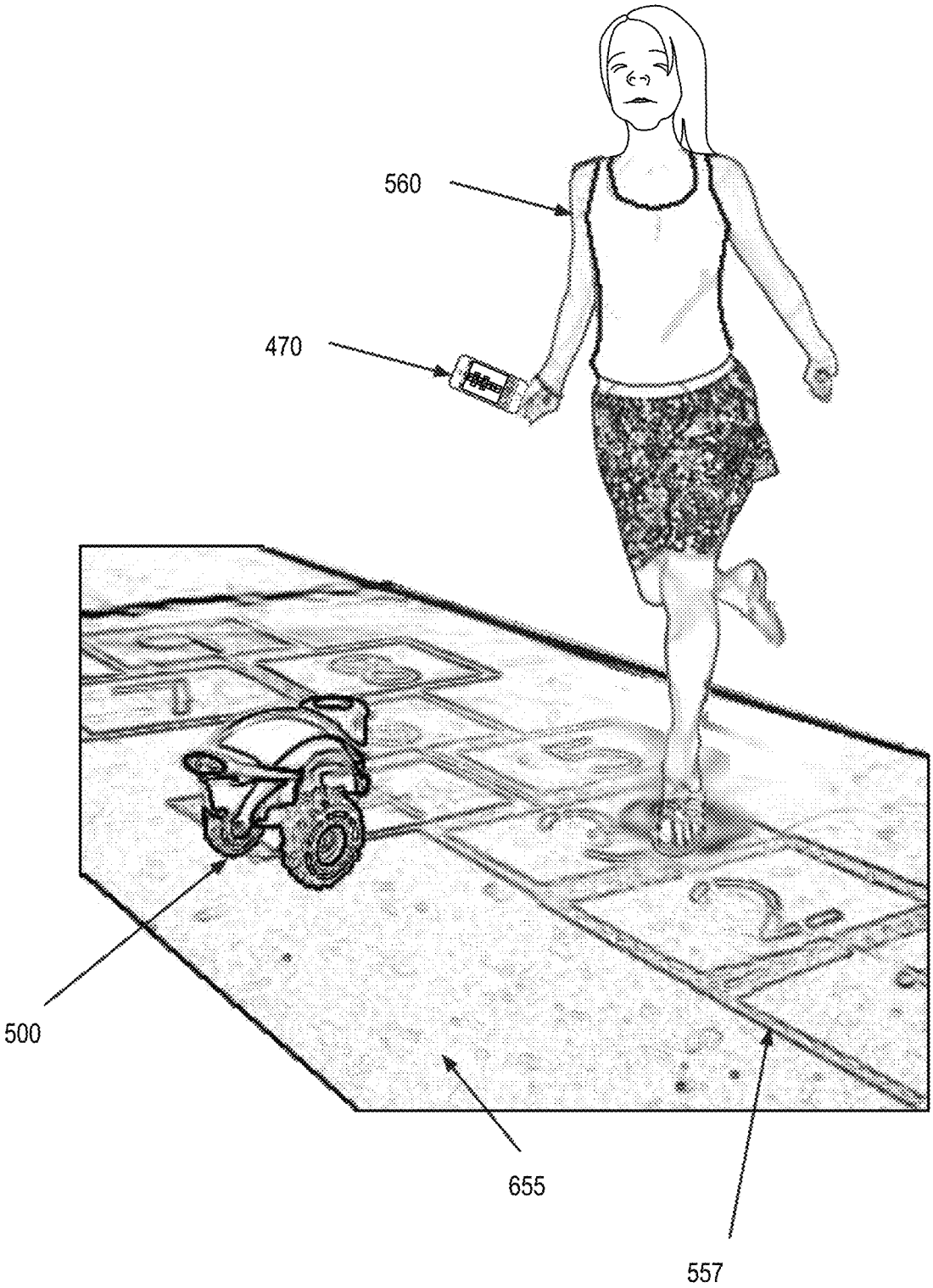
FIG. 15 is a perspective view of the motorized drawing vehicle of FIG. 14, shown in operation.

FIG. 15 is a perspective view of the motorized drawing vehicle 500 of FIG. 14, shown in operation. As shown therein, the motorized drawing vehicle 500 has completed drawing or "printing" a hopscotch game image 557, downloaded from a mobile smart device 470, on a pavement surface 655 or other surface. Once the image 557 is drawn on the pavement 555, the user 560 is able to play a game of hopscotch.

Figure 16:
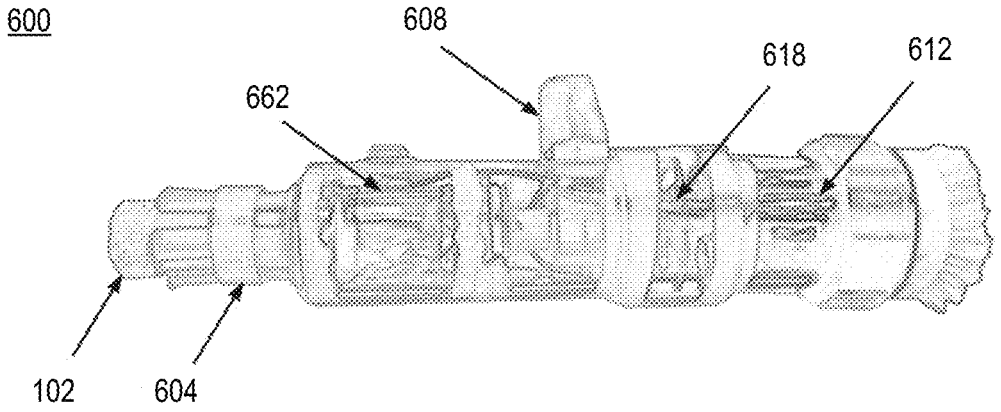
FIG. 16 is a perspective view of a handheld rotary sanding chalk device in accordance with one or more further preferred embodiments of the present invention.

Elements of control described herein may also be adapted for use in various handheld devices using rotary sanding chalk devices of the type described herein. For example, FIG. 16 is a perspective view of a handheld rotary sanding chalk device 600 in accordance with one or more further preferred embodiments of the present invention. The handheld rotary sanding chalk device 600 includes guidance alert elements 662, a chalk spinning motor 608, control electronics 110 (not shown), an axle or spindle (not shown), one or more sensors 618, one or more batteries 612, and a mounting structure 604. The guidance alert elements 662 can be lights, vibration, sound, or raised tactile buttons or other such devices or elements as known by an Ordinary Artisan, or in the industry or art, that may be used for the purposes and system as described herein. The device 600 holds a piece of chalk 102.

Figure 17:
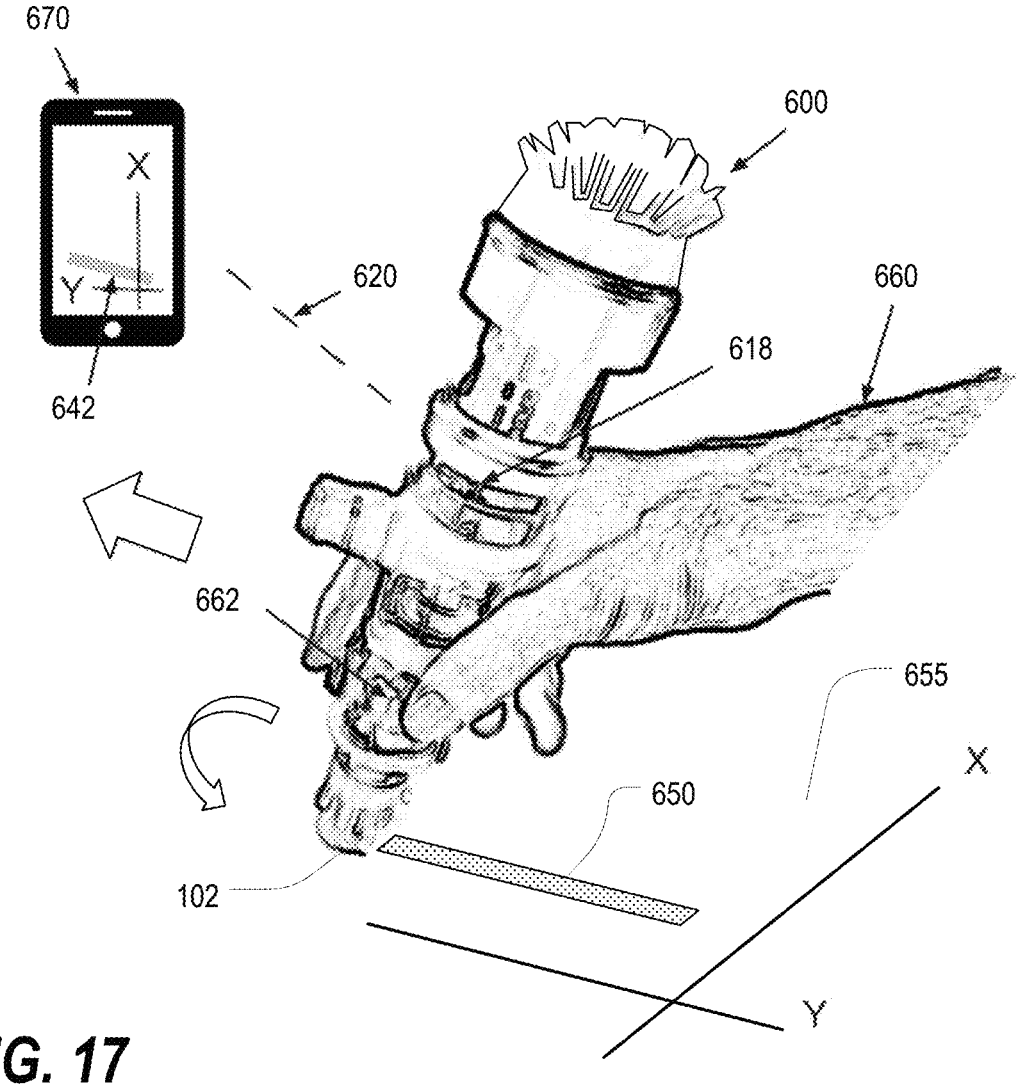
FIG. 17 is a perspective view of the handheld rotary sanding chalk device of FIG. 16, shown in operation.

FIG. 17 is a perspective view of the handheld rotary sanding chalk device 600 of FIG. 16, shown in operation. The user 660 loads a piece of chalk 102 into the device 600. A remote controller 240 or mobile device 670 uses a wireless communication method 620 to direct the user 660 drawing with the chalk device 600. Similar to the embodiment in FIG. 12, an application is opened on the mobile device 670 which allows the user to select and download an image or graphic 642. Once the image 642 is selected, commands are sent to the chalk device 600 through the communication method 620. For example, as the user presses the chalk device 600 to a hard surface 655, a forward movement command may be sent to the chalk device 600. The command is processed by the control electronics 110 and the motor 608 spins the axle 105, which spins the chalk 102, and the user 660 moves the device 600 forward the desired distance to create a line 650. Guidance alerts provided via the guidance alert elements 662 then tell the user which direction to turn the chalk device for the next command.

Figure 18:
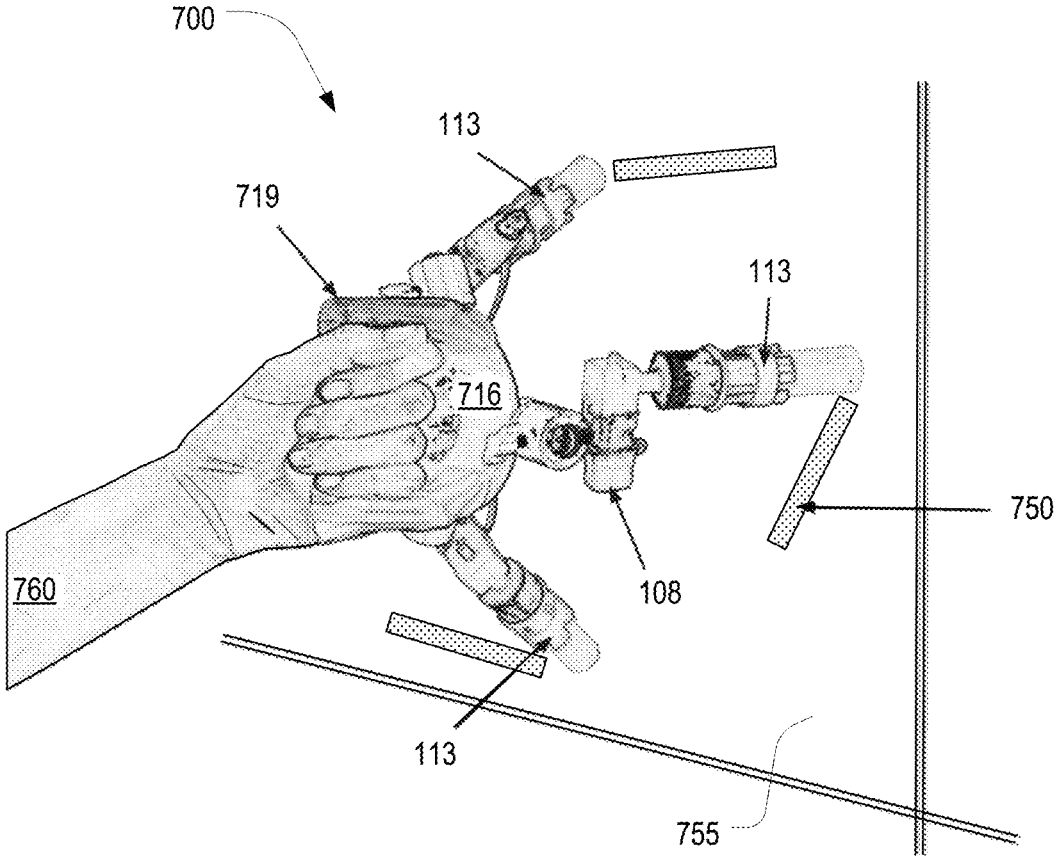
FIG. 18 is a perspective view of a mechanical rotary sanding chalk device with three rotary sanding chalk devices mounted to the vehicle in accordance with one or more further preferred embodiments of the present invention.

FIG. 18 is a perspective view of a handheld rotary sanding chalk device 700 with three rotary sanding chalk devices 113 mounted to the vehicle 700 in accordance with one or more further preferred embodiments of the present invention. This mechanical drawing vehicle is somewhat similar in form to the motorized drawing vehicle 300 in FIG. 5, but includes a handle 719 attached to the body 716 of the vehicle 700. The mechanical rotary sanding chalk device 700 may be controlled direction/force from the hand of the user 760, and in some embodiments, in combination with rotational friction from the rotary sanding action of a wall surface 755 or other surface against the chalk 102. As the chalk 102 is worn down it renders graphics 750 on the surface 755.

In some embodiments of the sanding chalk device 113, 213,413, the chalk 102,402 can also be vibrated with a vibration motor in order to more effectively sand the chalk 102,402 on a pavement or other hard surface. Such vibration be accomplished by any mechanical means as known by an Ordinary Artisan, or in the industry or art, that may be used for the purposes and system as described herein.

Figure 19:
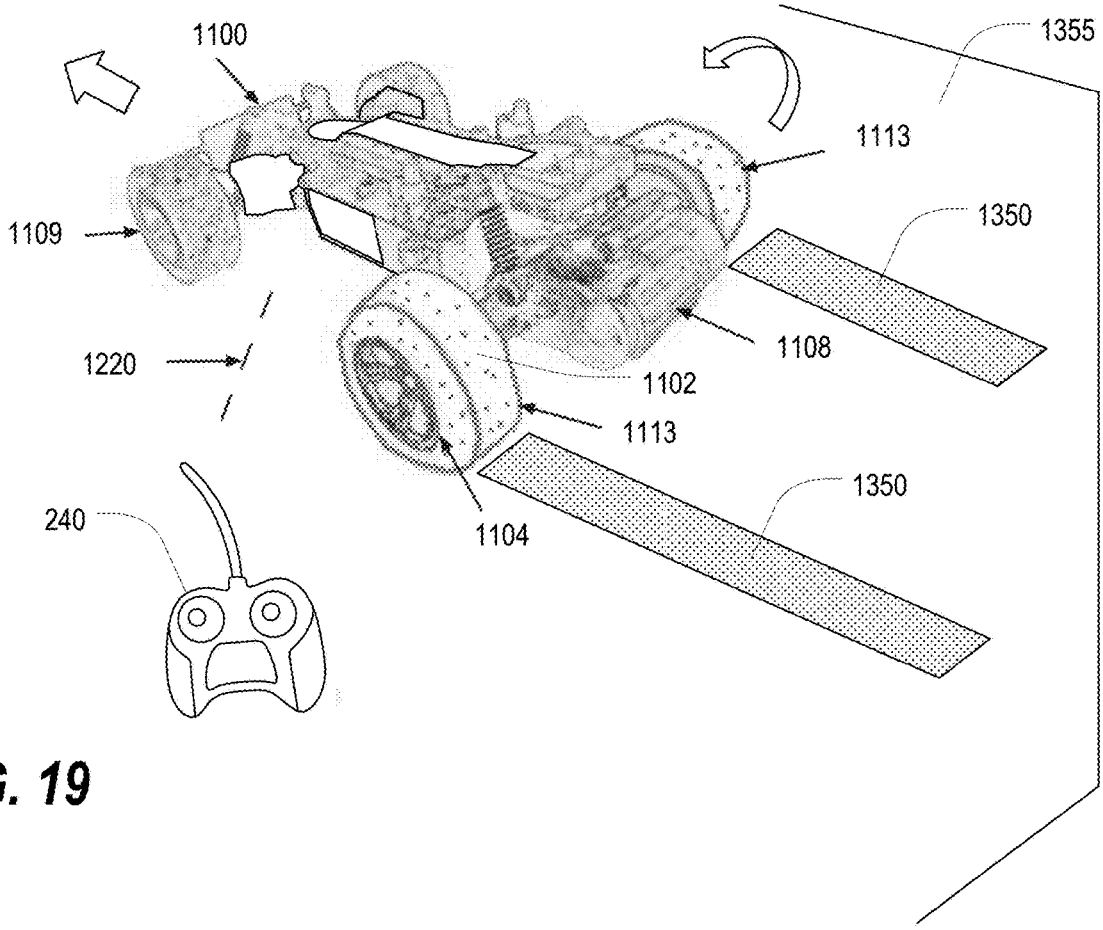
FIG. 19 is a perspective view of a motorized drawing vehicle having a plurality of chalk wheel assemblies in accordance with one or more further preferred embodiments of the present invention.

Rotational sanding may also used to apply graphics to a surface by substituting one or more chalk wheel assemblies for conventional wheel assemblies in a vehicle. In this regard, FIG. 19 is a perspective view of a motorized drawing vehicle 1100 having a plurality of chalk wheel assemblies in accordance with one or more further preferred embodiments of the present invention. As shown therein, this vehicle 1100 includes two chalk wheel assemblies 1113 and two standard wheel assemblies 1109. Each chalk wheel assembly 1113 includes a chalk tire 1102 mounted on a wheel or other mounting device 1104. The standard wheel assembly 1109 includes a standard tire mounted on a wheel. Two chalk wheel assemblies 1113 are connected to one axle or axle assembly 1105, while the two standard wheel assemblies 1109 are connected to another axle or axle assembly. However, in some embodiments the chalk wheel assembly may include a separate axle for each of the mounting devices and chalk tires, and in some embodiments the standard wheel assembly may include a separate axle for each of the wheels and standard tires.

Figure 20:
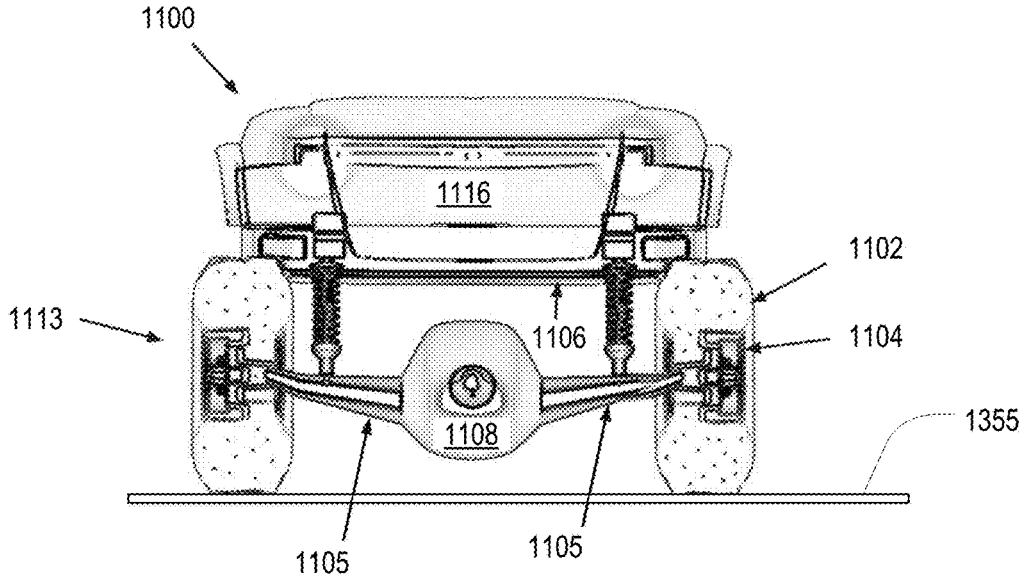
FIG. 20 is a rear-cross-sectional view of the drawing vehicle of FIG. 19.

FIG. 20 is a rear-cross-sectional view of the drawing vehicle 1100 of FIG. 19. The axle 1105 is connected to and being driven by a motor 1108. The axle 1105 and motor 1108 are attached to a chassis 1106 through structural and mechanical components. The body 1116 of the drawing vehicle 1100 is also attached to the chassis 1106.

The drawing vehicle 1100 shown in FIG. 19 uses one or more motors 1108 connected to the chassis 1106 to drive the chalk wheel assemblies 1113 for various acceleration, speed and direction. While being sanded and worn down and rendering graphics 1350, the two ring or torus-shaped chalk tires 1102, also provide locomotion for the drawing vehicle 1100. The standard wheel assemblies 1109 may be powered or unpowered. In the arrangement shown in FIG. 19, operation of the wheel assemblies 1113,1109, and thus the vehicle, is being controlled by a remote controller 240 to render graphics 1350 on a pavement surface 1355. The remote controller 240 is in communication with the drawing vehicle 1100 through a communication method 1220. The method of use of the drawing vehicle 1100 is shown in the flow diagram 5000 of FIG. 26 (described below).

Figure 21:
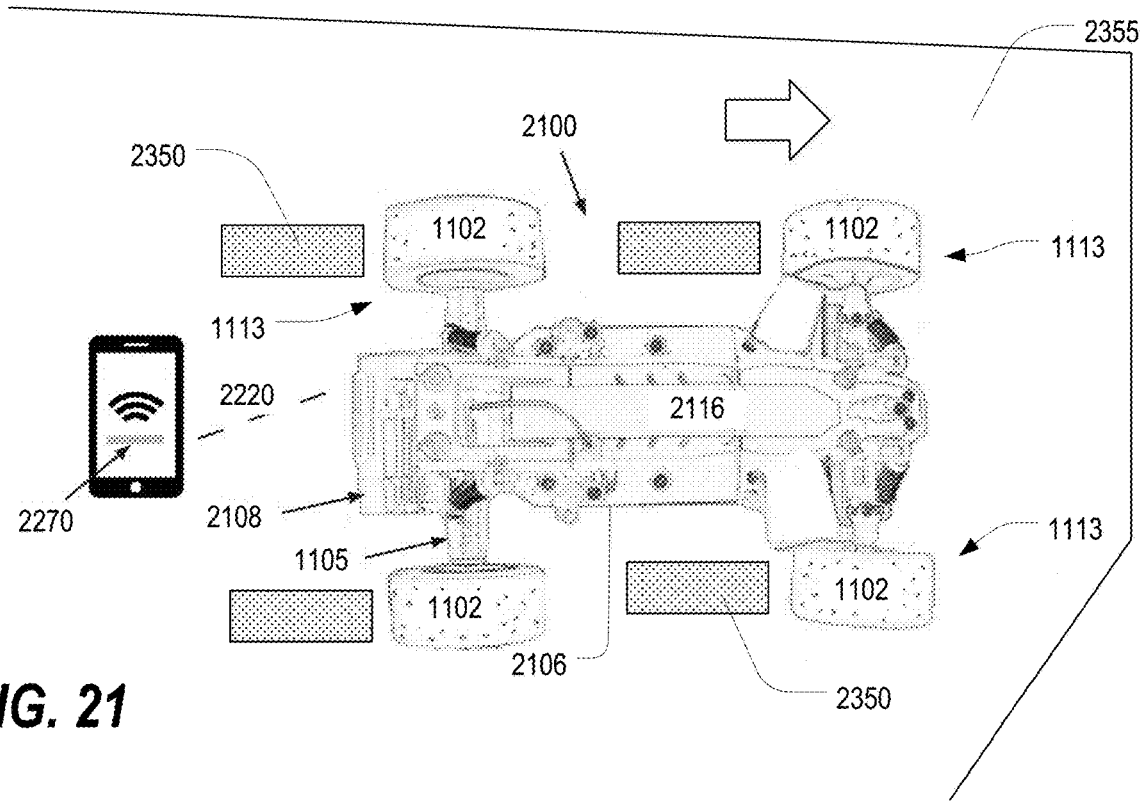
FIG. 21 is a top perspective view of a motorized drawing vehicle wherein all of the wheel assemblies are chalk wheel assemblies in accordance with one or more further preferred embodiments of the present invention.
Figure 22:
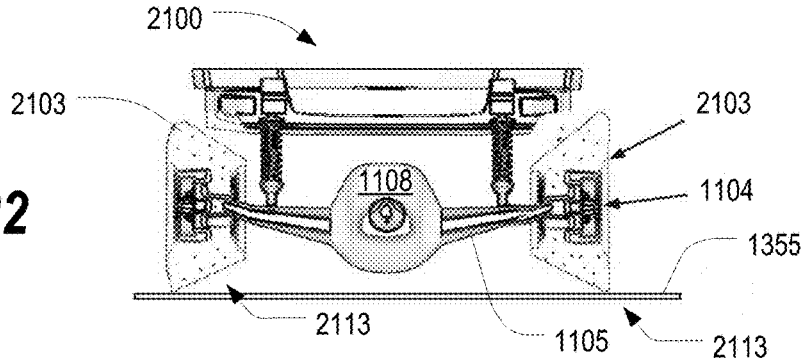
FIG. 22 is a rear cross-sectional view of the motorized drawing vehicle of FIG. 20 shown using wheel assemblies wherein semi-conical chalk tires have been substituted for the ring-shaped chalk tires of FIG. 20.
Figure 23:
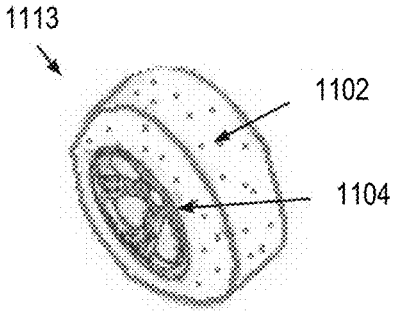
FIG. 23 is a perspective view of one of the chalk wheel assemblies of FIGS. 19-21.

FIG. 23 is a perspective view of one of the chalk wheel assemblies 1113 of FIGS. 19-21, and FIG. 24 is a front cross-sectional view of the chalk wheel assembly 1113 of FIG. 23. The chalk tires 1102 are made of solid chalk and are ring- or torus-shaped. However, other tire shapes may be substituted out of necessity or for a particular purpose. In this regard, FIG. 22 is a rear cross-sectional view of the motorized drawing vehicle 1100 of FIG. 20 shown using wheel assemblies 2113 wherein semi-conical chalk tires 2103 have been substituted for the ring-shaped chalk tires 1102 of FIG. 20. The chalk wheel assembly 1113,2113 is semi-permanently mounted to an axle 1105, which is connected to and being driven by the motor 1108. In at least some embodiments, each chalk wheel assembly 1113,2113 is unitary, wherein the chalk tire 1102,2103 is permanently mounted to the wheel or mounting device 1104 during the manufacture process. The method of manufacture for this chalk wheel assembly 1113,2113 is shown in the flow diagram 5500 of FIG. 27 (described below).

It will be appreciated that different chalk shapes may be utilized for various purposes. For example, the chalk 102, 402 shown in FIGS. 1-18 is a cylinder shape; the chalk 1102 shown in FIGS. 19-21, 23, and 24 has a ring shape (flat around its periphery) or a torus shape; and the chalk 1103 shown in FIG. 22 has a semi-conically-shaped "ring." Chalk of different shapes will produce different effects and line types (for example, thick or thin lines) when rotary sanded on or by a pavement surface.

It will be appreciated that the numbers and locations of the chalk wheel assemblies 1113,2113 relative to the standard wheel assemblies 1109 may be varied, and in some embodiments the standard wheel assemblies 1109 may be omitted altogether. In this regard, FIG. 21 is a top perspective view of a motorized drawing vehicle 2100 wherein all of the wheel assemblies are chalk wheel assemblies 1113 in accordance with one or more further preferred embodiments of the present invention. The drawing vehicle 2100 of FIG. 21 utilizes four chalk wheel assemblies 1113, all being controlled by a mobile smart device 2270 to render graphics 2350 (based on images displayed and stored on the mobile smart device 2270) on a pavement surface 2355. The smart device 2270 is shown being in communication with the drawing vehicle 2100 through a wireless communication method 2220. The drawing vehicle 2100 shown in FIG. 21 uses one or multiple motors 2108 connected to a chassis 2106, to drive the chalk wheel assemblies 1113 for various acceleration, speed and direction. The drawing vehicle 2100 has a vehicle body 2116 which is the exterior envelope of the drawing vehicle 2100. While being sanded and worn-down and rendering the graphic 2350, the four chalk tires 1102 that are installed, also provide locomotion for drawing vehicle 2100.

For the drawing vehicles 1100,2100 shown in FIGS. 19 through 22, it is understood that the chalk tires 1102,2103 will wear down through use. In order to change the chalk tires 1102,2103, a user would remove both the chalk tires 1102,2103 and mounting devices 1104 together, since they are one integrated unit. The chalk tire mounting devices 1104 are preferably only semi-permanently mounted on an axle 1105, so the chalk wheel assembly 1113,2113 can be easily removed from the axle 1105 by a user and changed and replaced with a spare or new chalk wheel assembly 1113,2113, when the chalk tire 1102 has been sanded and worn down by locomotion, rotary sanding and drawing. Once a chalk tire 1102,2103 is worn down, a wheel 1104 can be removed from an axle 1105 and disposed of. The user may then mount a new chalk wheel assembly 1113,2113 on an axle 1105. The chalk wheel assembly 1113,2113 shown in FIGS. 19-24 preferably includes the mechanical means to be semi-permanently mounted, removed and remounted on the axle 1105 by a user.

Figure 25:
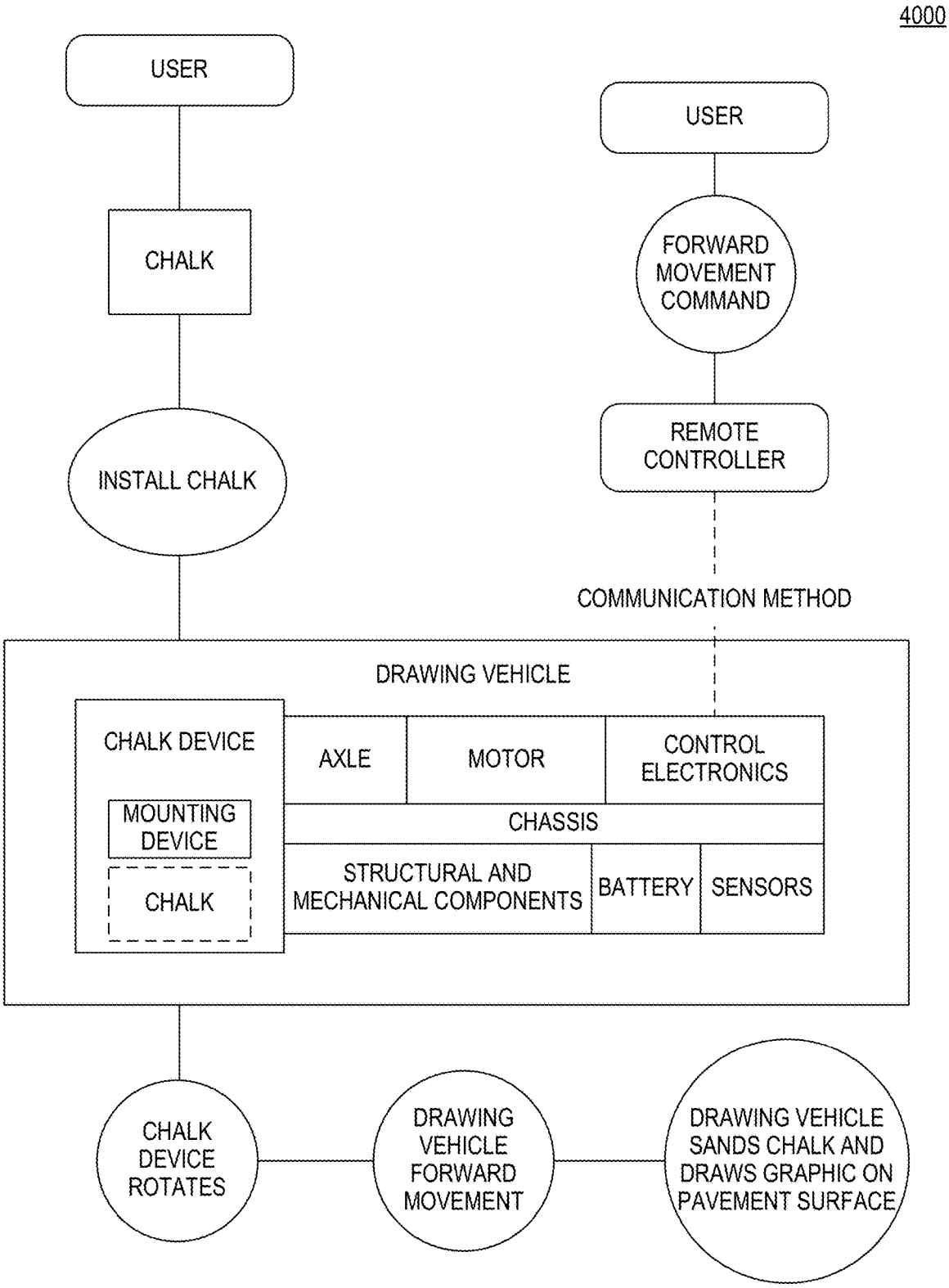
FIG. 25 is a flow diagram showing one method of use in accordance with one or more further preferred embodiments of the present invention.

FIG. 25 is a flow diagram showing one method 4000 of use in accordance with one or more further preferred embodiments of the present invention. In this method 4000, the user takes chalk 102,402,502 and installs it in the rotary sanding chalk device(s) 113,213,413,513 of a drawing vehicle 100,200,400,500. Once chalk 102 has been installed, the user operates a remote controller 140,240, smart device 470, or the like with a forward movement command, where the remote controller 140,240 or smart device 470 communicates the forward movement command to the drawing vehicle 100,200,400,500 through a communication method 120,220,520. Once the forward movement command has been received and processed by the control electronics 110,410, a motor 108,408 initiates and spins the chalk device 113,213,413,513. With the rotation of the chalk device 113,213,413,513, the chalk 102,402 provides locomotion and the drawing vehicle 100,200,400,500 moves forward. At the same time the chalk 102,402 is rotary sanded against a pavement surface 155,255,455,555 to draw graphics 150, 250,450,550,650. This method 4000 of use may be used, for example, for the drawing vehicles 100,200,400,500 of FIGS. 2-4 and FIGS. 6-15.

Figure 24:
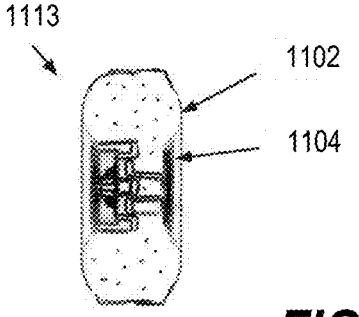
FIG. 24 is a front cross-sectional view of the chalk wheel assembly of FIG. 23.
Figure 26:
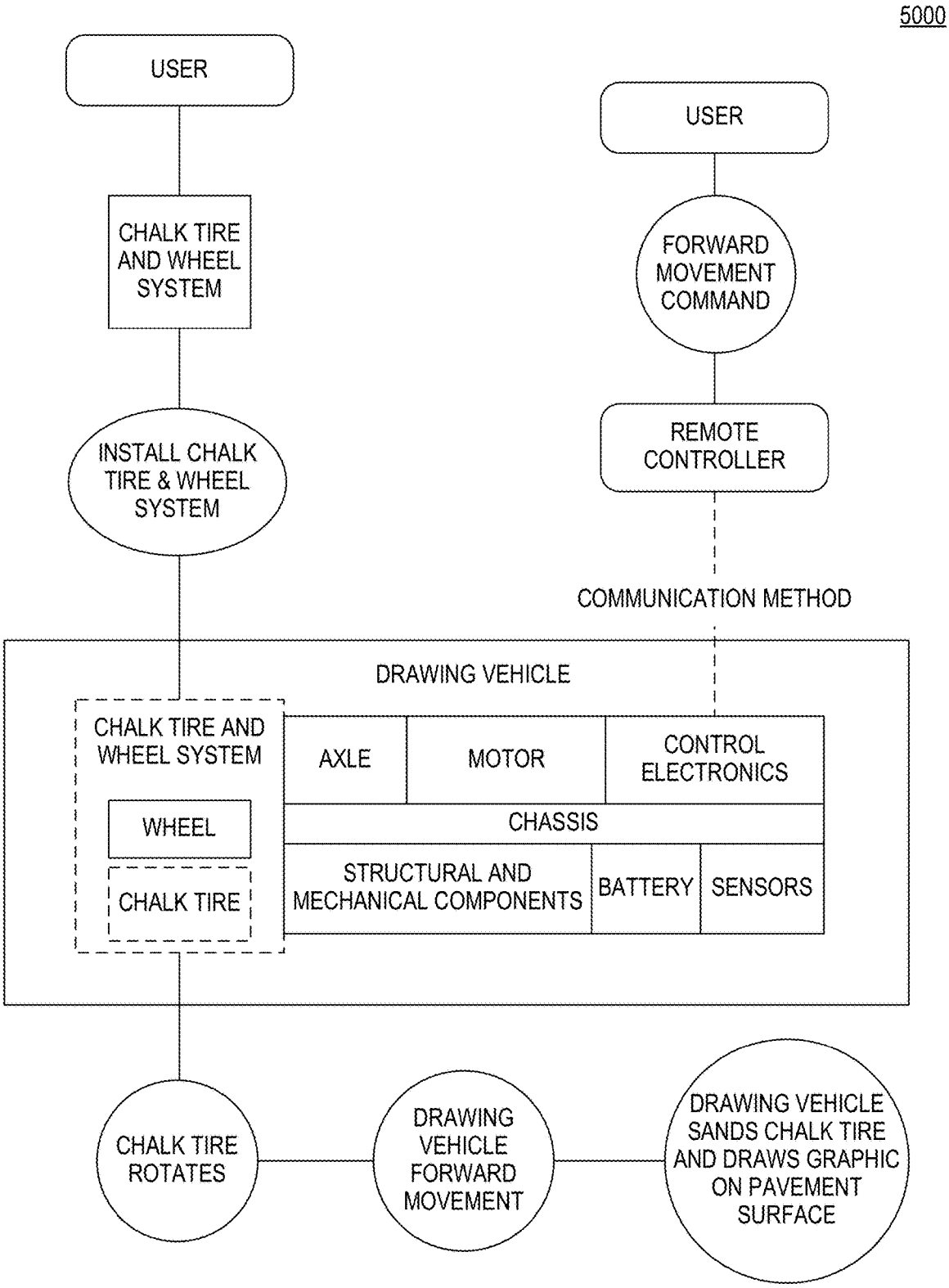
FIG. 26 is a flow diagram showing a second method of use in accordance with one or more further preferred embodiments of the present invention.

FIG. 26 is a flow diagram showing a second method 5000 of use in accordance with one or more further preferred embodiments of the present invention. In this method 5000, the user takes the chalk wheel assemblies 1113,2113 as shown in FIGS. 23 and 24 and installs them on an axle 1105 of a vehicle 1100,2100. Once the chalk wheel assemblies 1113,2113 have been installed, a user operates a remote controller 240 or smart device 2270 with a forward movement command, where the remote controller 240 or smart device 2270 communicates the forward movement command to the drawing vehicle 1100,2100 through a communication method 1220. Once the forward movement command has been received and processed by the control electronics 110, a motor 1108 initiates and turns an axle 1105 and the chalk wheel assembly 1113,2113. With the rotation of chalk wheel assembly 1113,2113, the chalk tires 1102, 1103 provide locomotion and the drawing vehicle 1100,2100 moves forward. At the same time the chalk tire 1102,1103 is rotary sanded against a pavement surface 1355,2355 to draw graphics 1350,2350. This method 5000 of use may be used, for example, for the drawing vehicles 1100,2100 of FIGS. 19-22.

Figure 27:
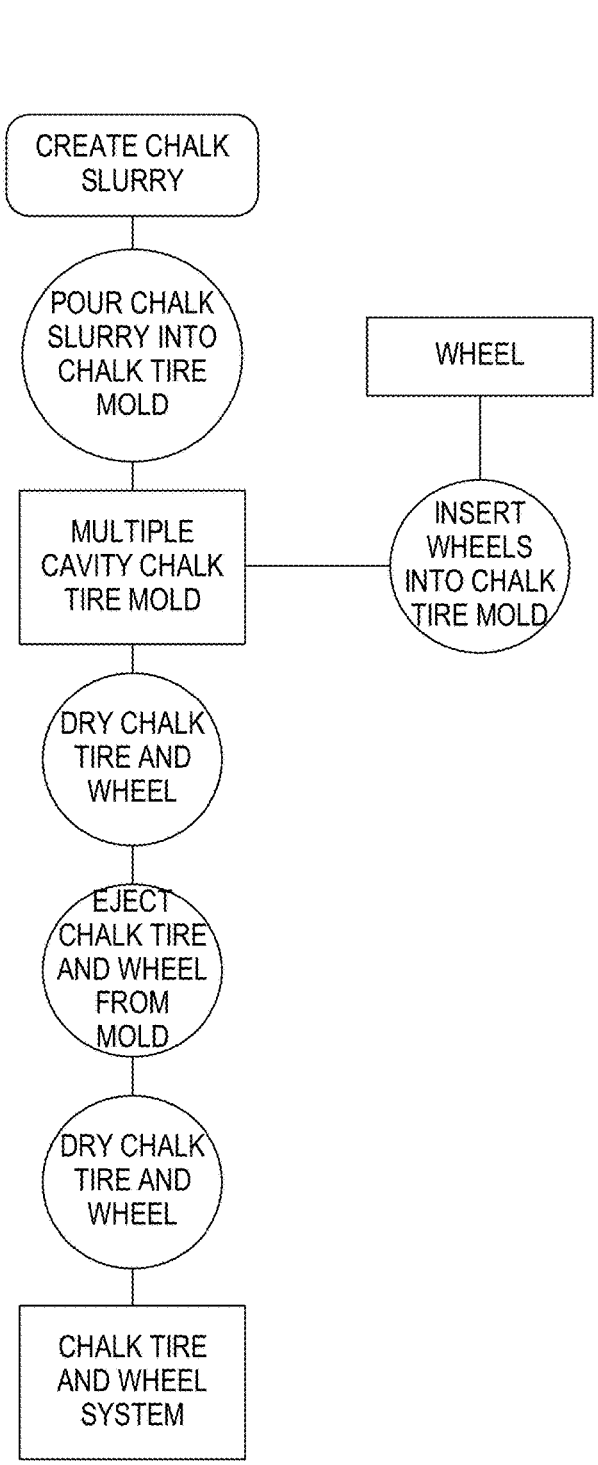
FIG. 27 is a flow diagram showing a method of manufacture of a chalk wheel assembly in accordance with one or more further preferred embodiments of the present invention.

FIG. 27 is a flow diagram showing a method 5500 of manufacture of a chalk wheel assembly 1113,2113 in accordance with one or more further preferred embodiments of the present invention. As shown in FIG. 27, a chalk wheel assembly 1113,2113 is manufactured by the method and process of mold casting and by using chalk slurry to cast a chalk tire 1102,2103 in a shape mold directly around a wheel 1104 during manufacture, for permanent mounting of a chalk tire 1102,2103 on a wheel 1104. Once the chalk wheel assembly 1113,2113 is cast, it is removed from the casting mold and dried.

In this method 5500 of manufacture, a preliminary step is to create chalk slurry by mixing together chalk with water, so the chalk is in a liquid and pourable form. Other ingredients may be added to the chalk slurry, such as pigment coloring and like, pending desired features. The chalk slurry is then poured into a multiple cavity tire mold to cast a chalk wheel assembly 1113,2113. Preferably the tire mold has multiple cavities, where multiple chalk wheel assemblies 1113,2113 can be produced. Once the chalk slurry is poured into the multiple cavity tire mold, a wheel 1104 is inserted into each of the chalk slurry filled, tire mold cavities. As an alternate method, a wheel 1104 may be inserted into the tire mold first and then the tire mold filled with the chalk slurry. In either method, a wheel 1104 is encapsulated in chalk slurry in the tire mold. The chalk slurry and wheel 1104 are then dried in the tire mold, and then ejected from the mold, thus producing a cast chalk wheel assembly 1113,2113 where a chalk tire 1102,1103 is permanently mounted on a wheel 1104. The chalk wheel assembly 1113,2113 may then be additionally dried to the desired hardness.

Figure 28:
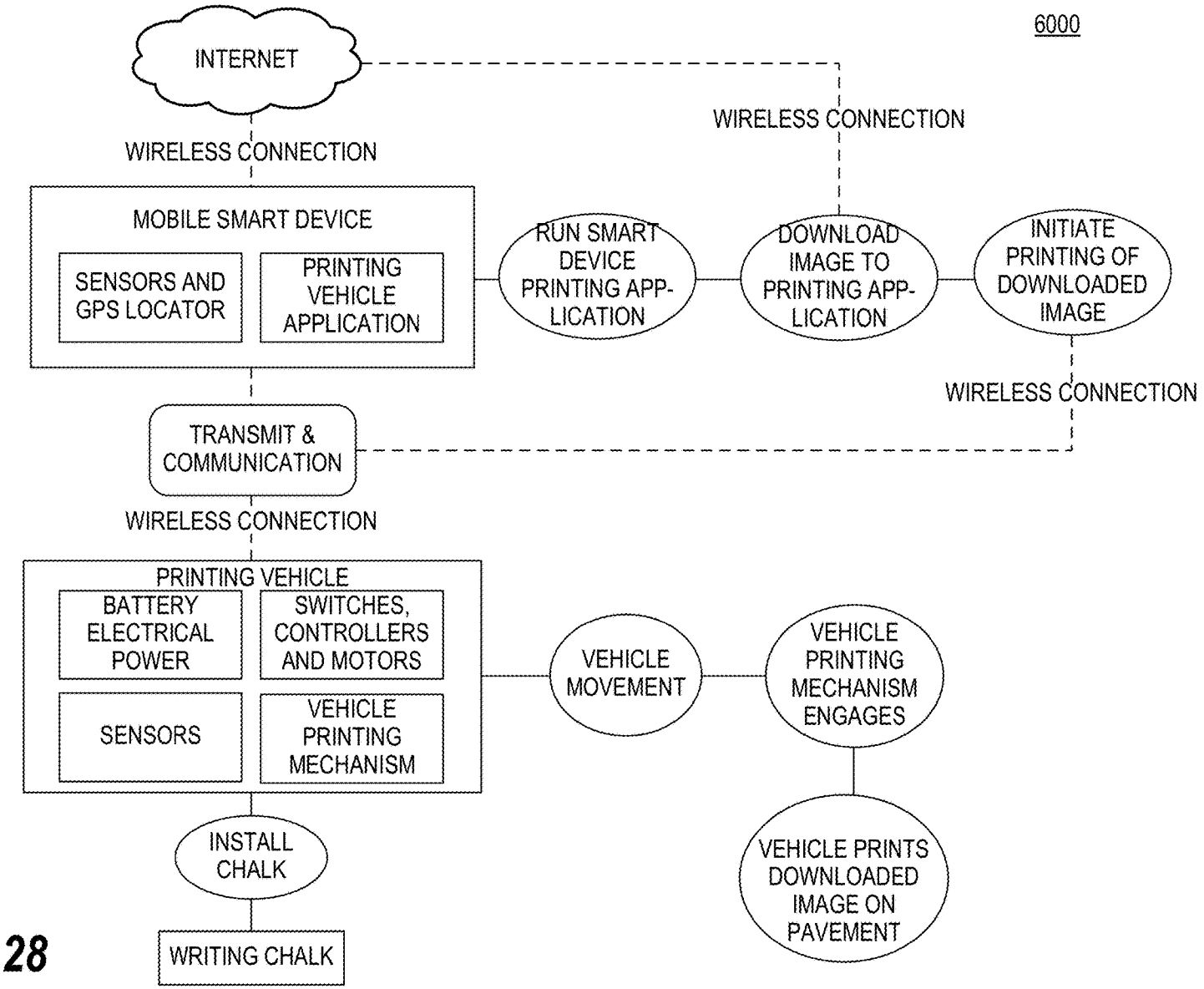
FIG. 28 is a flow diagram showing a method of use in accordance with one or more further preferred embodiments of the present invention.

FIG. 28 is a flow diagram showing a method 6000 of use in accordance with one or more further preferred embodiments of the present invention. In this method 6000, a wireless smart device 470 accesses images in the internet cloud, and then the images are drawn or printed by a drawing vehicle 400, 500.

More specifically, in this method 6000, a user loads or installs chalk 102,402 into a rotary sanding chalk device 413,513 of a drawing vehicle 400,500. Then the user places the drawing vehicle 400, 500 on a pavement surface 455, 555. The user then launches the printing vehicle application 480 on a smart device 470 by using the printing vehicle application 480 executable button located on the screen of the smart device 470. Using the printing vehicle application 480, the user accesses the internet cloud through the smart device 470 and locates an image on the internet. The user then downloads the internet cloud based image to the smart device 470. Once the image has been downloaded to the smart device 470, the user selects the image and sends it to the drawing vehicle 400,500 using the printing vehicle application 480. The drawing vehicle 400,500 then engages and draws or prints the downloaded image on the pavement surface 455,555 with chalk 102,402.

Figure 29:
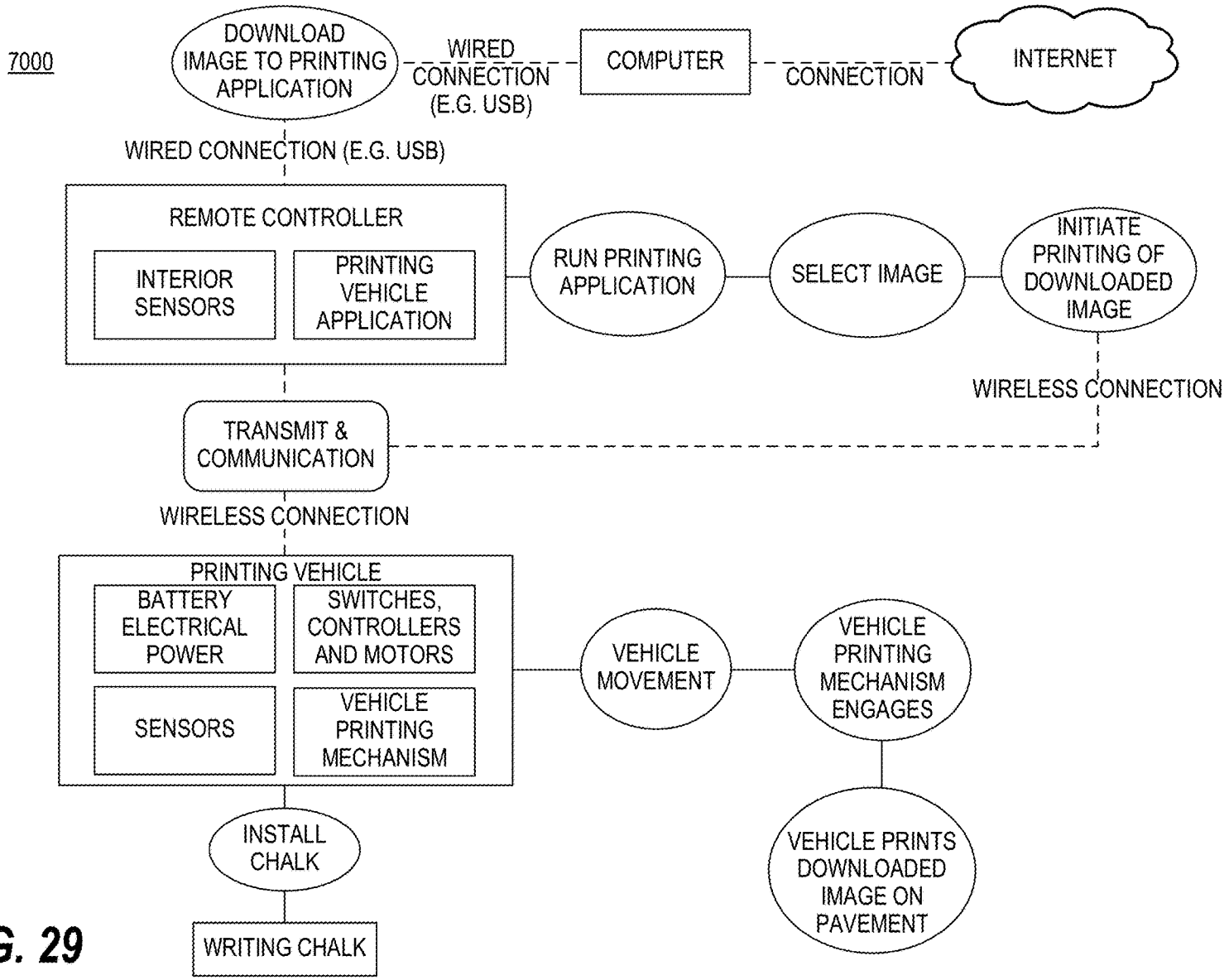
FIG. 29 is a flow diagram showing a method of use in accordance with one or more further preferred embodiments of the present invention.

FIG. 29 is a flow diagram showing a method 7000 of use in accordance with one or more further preferred embodiments of the present invention. In this method 7000, a remote controller 240 is connected to a computer 570 via wireless communication 620. The computer 570 accesses images in the internet cloud, and then directions are given to the drawing vehicle 400,500 from the computer through the remote controller 240 to draw or print the image on pavement or other hard surface similar to method 6000.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof.

What is claimed is:

1. A system utilizing rotational movement of a piece of chalk to apply a graphic to a surface, comprising:

(a) a chalk-drawing vehicle to be driven on a surface, including:

(i) a chassis adapted to move relative to the surface without being attached thereto, (ii) a motor connected to the chassis, (iii) a wireless receiver to receive operational input, (iv) a solid piece of chalk supported by a mounting structure carried by the chassis as the chassis moves relative to the surface, wherein the solid piece of chalk is part of a rotary sanding chalk device, and (v) two wheels, at least one of which is motorized to impart movement of the chassis relative to the surface, (vi) wherein the rotary sanding chalk device further comprises a rotatable axle or spindle that transmits rotational movement from the motor to the solid piece of chalk via the mounting structure, wherein the axle or spindle rotates about an axis that is directed downward toward the surface such that a lower end of the solid piece of chalk is sanded by the surface on which the vehicle is driven to render the graphic to the surface, (vii) wherein the chassis is adapted to be supported on the surface at exactly three support points, with the lower end of the solid piece of chalk being one of the three support points and the two wheels being a second and a third of the three support points, and (viii) wherein the three support points are non-linear with respect to each other such that a portion of a weight of the vehicle is carried on the solid piece of chalk thereby both at a time of initial use and after the chalk has been substantially sanded, without adjustment by a user; and (b) a remote communication device, including a transmitter, to provide the operational input to the vehicle, via the wireless receiver, to control the chalk drawing vehicle.

2. A system utilizing rotational movement of a piece of chalk to apply a graphic to a surface, comprising:

(a) a chalk-drawing vehicle to be driven on a surface, including:

(i) a chassis adapted to move relative to the surface without being attached thereto, (ii) a wireless receiver to receive operational input, (iii) a motor, (iv) a first support point for the chassis, the first support point comprising a solid piece of chalk connected to the chassis by a mounting structure as the chassis moves relative to the surface, wherein the solid piece of chalk is part of a rotary sanding chalk device, (v) a second support point for the chassis, and (vi) a third support point for the chassis, (vii) wherein the rotary sanding chalk device further comprises a rotatable axle or spindle that transmits rotational movement from the motor to the solid piece of chalk via the mounting structure, wherein the axle or spindle rotates about an axis that is directed downward toward the surface such that a lower end of the solid piece of chalk is sanded by the surface on which the vehicle is driven to render the graphic to the surface, (viii) wherein the chassis is adapted to be supported on the surface entirely at the three support points, and (ix) wherein the three support points are non-linear with respect to each other such that a portion of a weight of the vehicle is carried on the solid piece of chalk thereby both at a time of initial use and after the chalk has been substantially sanded, without adjustment by a user; and (b) a remote communication device, including a transmitter, to provide the operational input to the vehicle, via the wireless receiver, to control the chalk drawing vehicle.

3. The system of claim 2, wherein the second support point is a wheel.

4. The system of claim 3, wherein the wheel is motorized to impart movement of the chassis relative to the surface.

5. The system of claim 3, wherein the wheel is a first wheel and wherein the third support point is a second wheel.

6. The system of claim 5, wherein the first and second wheels are motorized to impart movement of the chassis relative to the surface.

7. The system of claim 2, wherein the solid piece of chalk, mounting structure, rotatable axle or spindle, and axis are a first solid piece of chalk, first mounting structure, first rotatable axle or spindle, and first axis, wherein the second support point comprises a second solid piece of chalk, a second mounting structure, and a second rotatable axle or spindle, wherein the second rotatable axle or spindle rotates about a second axis that is directed downward toward the surface such that a lower end of the second solid piece of chalk is sanded by the surface on which the vehicle is driven to render the graphic to the surface, and wherein rotational movement is transmitted to the second solid piece of chalk via the second mounting structure to effectuate the sanding of the second solid piece of chalk by the surface.

8. The system of claim 7, wherein the third support point comprises a third solid piece of chalk, a third mounting structure, and a third rotatable axle or spindle, wherein the third rotatable axle or spindle rotates about a third axis that is directed downward toward the surface such that a lower end of the third solid piece of chalk is sanded by the surface on which the vehicle is driven to render the graphic to the surface, and wherein rotational movement is transmitted to the third solid piece of chalk via the third mounting structure to effectuate the sanding of the third solid piece of chalk by the surface.

9. A chalk-drawing apparatus to be operated on a surface, comprising:

(a) a chassis adapted to move relative to a surface without being attached thereto;

(b) a motor connected to the chassis;

(c) a first support point for the chassis, the first support point comprising a solid piece of chalk connected to the chassis by a mounting structure as the chassis moves relative to the surface, wherein the solid piece of chalk is part of a rotary sanding chalk device;

(d) a second support point for the chassis; and (e) a third support point for the chassis;

(f) wherein the rotary sanding chalk device further comprises a rotatable axle or spindle that transmits rotational movement from the motor to the solid piece of chalk via the mounting structure, wherein the axle or spindle rotates about an axis that is directed downward toward the surface such that a lower end of the solid piece of chalk is sanded by the surface on which the chassis is moved to render the graphic to the surface;

(g) wherein the chassis is adapted to be supported on the surface entirely at the three support points; and (h) wherein the three support points are non-linear with respect to each other such that a portion of a weight of the chassis is carried on the solid piece of chalk thereby both at a time of initial use and after the chalk has been substantially sanded, without adjustment by a user.

10. The chalk-drawing apparatus of claim 9, wherein the second support point is a wheel.

11. The chalk-drawing apparatus of claim 10, wherein the wheel is motorized to impart movement of the chassis relative to the surface.

12. The chalk-drawing apparatus of claim 10, wherein the wheel is a first wheel and wherein the third support point is a second wheel.

13. The chalk-drawing apparatus of claim 12, wherein the first and second wheels are motorized to impart movement of the chassis relative to the surface.

14. The chalk-drawing apparatus of claim 9, wherein the solid piece of chalk, mounting structure, rotatable axle or spindle, and axis are a first solid piece of chalk, first mounting structure, first rotatable axle or spindle, and first axis, wherein the second support point comprises a second solid piece of chalk, a second mounting structure, and a second rotatable axle or spindle, wherein the second rotatable axle or spindle rotates about a second axis that is directed downward toward the surface such that a lower end of the second solid piece of chalk is sanded by the surface to render the graphic to the surface, and wherein rotational movement is transmitted to the second solid piece of chalk via the second mounting structure to effectuate the sanding of the second solid piece of chalk by the surface.

15. The chalk-drawing apparatus of claim 14, wherein the third support point comprises a third solid piece of chalk, a third mounting structure, and a third rotatable axle or spindle, wherein the third rotatable axle or spindle rotates about a third axis that is directed downward toward the surface such that a lower end of the third solid piece of chalk is sanded by the surface to render the graphic to the surface, and wherein rotational movement is transmitted to the third solid piece of chalk via the third mounting structure to effectuate the sanding of the third solid piece of chalk by the surface.

* * * * *